US010177438B2

(12) United States Patent
Sun et al.

(10) Patent No.: US 10,177,438 B2
(45) Date of Patent: Jan. 8, 2019

(54) MULTI-BAND ANTENNA ARRAYS WITH COMMON MODE RESONANCE (CMR) AND DIFFERENTIAL MODE RESONANCE (DMR) REMOVAL

(71) Applicant: CommScope Technologies LLC, Hickory, NC (US)

(72) Inventors: Jing Sun, Suzhou (CN); Ligang Wu, Suzhou (CN); Hangsheng Wen, Suzhou (CN); Martin Zimmerman, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 85 days.

(21) Appl. No.: 15/482,114

(22) Filed: Apr. 7, 2017

(65) Prior Publication Data

US 2017/0294704 A1 Oct. 12, 2017

(30) Foreign Application Priority Data

Apr. 8, 2016 (CN) ..... 2016 1 0370869

(51) Int. Cl.
*H01Q 21/00* (2006.01)
*H01Q 1/24* (2006.01)
(Continued)

(52) U.S. Cl.
CPC ..... *H01Q 1/242* (2013.01); *H01Q 5/30* (2015.01); *H01Q 19/10* (2013.01);
(Continued)

(58) Field of Classification Search
CPC ..... H01Q 1/246; H01Q 1/242; H01Q 21/26; H01Q 21/08; H01Q 19/062; H01Q 1/42; H01Q 5/20
(Continued)

(56) References Cited

U.S. PATENT DOCUMENTS

2005/0280579 A1 12/2005 Liang et al.
2012/0280878 A1 11/2012 Timofeev
(Continued)

FOREIGN PATENT DOCUMENTS

CN 204857971 U 12/2015
WO WO 2012/159406 A1 11/2012

OTHER PUBLICATIONS

Notification of Transmittal of the International Search Report and the Written Opinion of the International Searching Authority, or the Declaration, in corresponding PCT Application No. PCT/US2017/026516 dated Jul. 25, 2017 (15 pages).

*Primary Examiner* — Joseph Lauture
(74) *Attorney, Agent, or Firm* — Myers Bigel, P.A.

(57) ABSTRACT

A multi-band radiating array includes a planar reflector, first radiating elements defining a first column on the planar reflector, second radiating elements defining a second column on the planar reflector alongside the first column, and third radiating elements interspersed between the second radiating elements in the second column. The first radiating elements have a first operating frequency range, the second radiating elements have a second operating frequency range that is lower than the first operating frequency range, and the third radiating elements have a third, narrowband operating frequency range that is higher than the second operating frequency range but lower than the first operating frequency range. Respective capacitors are coupled between elongated arm segments and an elongated stalk of the third radiating elements, and a common mode resonance of the third radiating elements is present in a lower frequency range than the second operating frequency range.

21 Claims, 19 Drawing Sheets

(51) Int. Cl.

| | |
|---|---|
| ***H01Q 5/30*** | (2015.01) |
| ***H01Q 19/10*** | (2006.01) |
| ***H01Q 21/06*** | (2006.01) |
| ***H01Q 21/26*** | (2006.01) |
| *H01Q 5/20* | (2015.01) |
| *H01Q 19/06* | (2006.01) |
| *H01Q 21/08* | (2006.01) |
| *H01Q 1/42* | (2006.01) |

(52) U.S. Cl.
CPC ..... *H01Q 21/0068* (2013.01); *H01Q 21/062* (2013.01); *H01Q 21/26* (2013.01); *H01Q 1/246* (2013.01); *H01Q 1/42* (2013.01); *H01Q 5/20* (2015.01); *H01Q 19/062* (2013.01); *H01Q 21/08* (2013.01)

(58) Field of Classification Search
USPC ..... 343/835
See application file for complete search history.

(56) References Cited

U.S. PATENT DOCUMENTS

2014/0139387 A1 5/2014 Jones et al.
2015/0372397 A1* 12/2015 Jonsson ..... H01Q 1/246
343/835

* cited by examiner

LL, TYPICAL DMR IMPACTS ON RB RL/ISO

MULTI-BAND ANTENNA ARRAYS WITH COMMON MODE RESONANCE (CMR) AND DIFFERENTIAL MODE RESONANCE (DMR) REMOVAL

CROSS REFERENCE TO RELATED APPLICATION

The present application claims priority under 35 U.S.C. § 119 from Chinese Patent Application Serial No. 201610370869.4, filed Apr. 8, 2016, the entire contents of which is incorporated herein by reference.

FIELD

The present invention generally relates to communications systems and, more particularly, to array antennas utilized in communications systems.

BACKGROUND

Multi-band antenna arrays, which can include multiple radiating elements with different operating frequencies, may be used in wireless voice and data communications. For example, common frequency bands for GSM services include GSM900 and GSM1800. A low-band of frequencies in a multi-band antenna may include a GSM900 band, which operates at 880-960 MHz. The low-band may also include Digital Dividend spectrum, which operates at 790-862 MHz. Further, the low-band may also cover the 700 MHz spectrum at 694-793 MHz.

A high-band of a multi-band antenna may include a GSM1800 band, which operates in the frequency range of 1710-1880 MHz. A high-band may also include, for example, the UMTS band, which operates at 1920-2170 MHz. Additional bands may comprise LTE 2.6, which operates at 2.5-2.7 GHz and WiMax, which operates at 3.4-3.8 GHz.

A dipole antenna may be employed as a radiating element, and may be designed such that its first resonant frequency is in the desired frequency band. To achieve this, each of the dipole arms may be about one quarter wavelength, and the two dipole arms together are about one half the wavelength of the desired band. These are referred to as "half-wave" dipoles, and may have relatively low impedance.

However, multi-band antenna arrays may involve implementation difficulties, for example, due to interference among the radiating elements for the different bands. In particular, the radiation patterns for a lower frequency band can be distorted by resonances that develop in radiating elements that are designed to radiate at a higher frequency band, typically 2 to 3 times higher in frequency. For example, the GSM1800 band is approximately twice the frequency of the GSM900 band. As such, the introduction of an additional radiating element having an operating frequency range different from the existing radiating elements in the array may cause distortion with the existing radiating elements.

There are two modes of distortion that are typically seen, Common Mode resonance and Differential Mode resonance. Common Mode (CM) resonance can occur when the entire higher band radiating element resonates as if it were a one quarter wave monopole. Since the stalk or vertical structure of the radiating element is often one quarter wavelength long at the higher band frequency and the dipole arms are also one quarter wavelength long at the higher band frequency, this total structure may be roughly one half wavelength long at the higher band frequency. Where the higher band is about double the frequency of the lower band, because wavelength is inversely proportional to frequency, the total high-band structure may be roughly one quarter wavelength long at a lower band frequency. Differential mode resonance may occur when each half of the dipole structure, or two halves of orthogonally-polarized higher frequency radiating elements, resonate against one another.

One approach for reducing CM resonance may involve adjusting the dimensions of the higher band radiator such that the CM resonance is moved either above or below the lower band operating range. For example, one proposed method for retuning the CM resonance is to use a "moat," described for example in U.S. patent application Ser. No. 14/479,102, the disclosure of which is incorporated by reference. A hole can be cut into the reflector around the vertical structure of the radiating element (the "feed board"). A conductive well may be inserted into the hole, and the feed board may be extended to the bottom of the well. This can lengthen the feed board, which may move the CM resonance lower and out of band, while at the same time keeping the dipole arms approximately one quarter wavelength above the reflector. This approach, however, may entail greater complexity and manufacturing cost.

In addition, a trade-off may exist between performance and spacing of the radiating elements in a multi-band antenna array. In particular, while array length may be used to achieve a desired beamwidth, it may be advantageous to reduce the number of radiating elements along the array length to reduce costs. However, reducing the number of radiating elements along the array length may result in increased spacing between the radiating elements, which may result in undesired grating lobes and/or attenuation.

SUMMARY

According to some embodiments of the present disclosure, a multi-band radiating array includes a reflector (e.g., a planar reflector), a plurality of first radiating elements defining a first column on the reflector, a plurality of second radiating elements defining a second column on the reflector alongside the first column, and a plurality of third radiating elements on the reflector interspersed between the second radiating elements in the second column. The first radiating elements have a first operating frequency range, the second radiating elements have a second operating frequency range that is lower (i.e., including lower frequencies) than the first operating frequency range, and the third radiating elements have a third, narrowband operating frequency range that is higher (i.e., including higher frequencies) than the second operating frequency range but lower than the first operating frequency range.

In some embodiments, the second and third radiating elements may respectively include a plurality of elongated arm segments defining at least one dipole antenna, and an elongated stalk that suspends the elongated arm segments above the planar reflector such that the elongated arm segments radially extend from an end of the elongated stalk and parallel to the planar reflector. The third radiating elements may respectively include respective capacitors coupled between the elongated arm segments and the elongated stalk thereof. A common mode resonance during operation of the third radiating elements may be present in a lower frequency range than the second operating frequency range. The lower frequency range may be less than about 690 MHz.

In some embodiments, at least two of the third radiating elements may be interspersed between two of the second radiating elements in a co-linear arrangement such that respective elongated stalks thereof are aligned along the second column.

In some embodiments, the third radiating elements may further respectively include respective inductors extending along a length of the elongated arm segments. The respective inductors may be serially coupled to the respective capacitors opposite the elongated stalk.

In some embodiments, the respective inductors may be respective first inductors, and the third radiating elements may further respectively include respective second inductors extending along the length of the elongated arm segments and serially coupled to the respective first inductors opposite the respective capacitors, such that the respective capacitors, the respective first inductors, and the respective second inductors are serially connected along the length of the elongated arm segments.

In some embodiments, the elongated arm segments may be defined by printed circuit boards including respective metal segments thereon, and the at least one dipole antenna may include first and second dipole antennas defined by the respective metal segments on opposing ones of the elongated arm segments in a cross dipole arrangement.

In some embodiments, the respective first inductors may be defined by respective first metal traces on the printed circuit boards coupling the respective capacitors to portions of the respective metal segments proximate the elongated stalk. The respective second inductors may be defined by respective second metal traces on the printed circuit boards extending between portions of the respective metal segments distal from the elongated stalk.

In some embodiments, for the third radiating elements, the elongated stalk may include a dielectric feed board substrate and metal layers on opposing surfaces thereof that define the respective capacitors.

In some embodiments, the planar reflector may include respective openings therein around respective elongated stalks of the third radiating elements. The respective openings may reduce coupling between the respective elongated stalks of the third radiating elements and the planar reflector.

In some embodiments, a plurality of the first radiating elements may define a third column alongside the second column opposite the first column such that the third radiating elements are positioned between the first and third columns.

In some embodiments, the third radiating elements may be laterally spaced by about 80 millimeters (mm) from the first radiating elements of the first column.

In some embodiments, the first operating frequency range may be about 1.7 GHz to about 2.7 GHz, the second operating frequency range may be about 694 MHz-960 MHz, and the third, narrowband operating frequency range may be about 1.4 GHz to about 1.5 GHz.

According to further embodiments of the present disclosure, a radiating element includes a plurality of elongated arm segments defining at least one dipole antenna having a narrowband operating frequency range. The radiating element further includes an elongated stalk configured to suspend the elongated arm segments above a planar reflector such that the elongated arm segments radially extend from an end of the elongated stalk and parallel to the planar reflector. Respective capacitors are coupled between the elongated arm segments and the elongated stalk. During operation, a common mode resonance of the radiating element is present in a lower frequency range than the narrowband operating frequency range.

In some embodiments, respective inductors may extend along a length of the elongated arm segments. The respective inductors may be serially coupled to the respective capacitors opposite the elongated stalk.

In some embodiments, the respective inductors may be respective first inductors, and respective second inductors may extend along the length of the elongated arm segments and may be serially coupled to the respective first inductors opposite the respective capacitors, such that the respective capacitors, the respective first inductors, and the respective second inductors are connected in series along the length of the elongated arm segments.

In some embodiments, the elongated arm segments may be defined by printed circuit boards including respective metal segments thereon, and the at least one dipole antenna may include first and second dipole antennas defined by the respective metal segments on opposing ones of the elongated arm segments in a cross dipole arrangement.

In some embodiments, the printed circuit boards may be first and second printed circuit boards arranged in a crossed configuration to define the elongated stalk as a dielectric feed board substrate and the elongated arm segments. The first and second dipole antennas may be defined by the metal segments of the first and second printed circuit boards, respectively, and the dielectric feed board may include feed lines that are configured to couple the first and second dipole antennas to an antenna feed.

In some embodiments, a spacer may be positioned at an end of the dielectric feed board substrate opposite from the elongated arm segments.

In some embodiments, the narrowband operating frequency range may be about 1.4 GHz to about 1.5 GHz, and the lower frequency range may be less than about 690 MHz.

BRIEF DESCRIPTION OF THE DRAWINGS

Aspects of the present disclosure are illustrated by way of example and are not limited by the accompanying drawings. In the drawings.

DETAILED DESCRIPTION

Figure 1A:
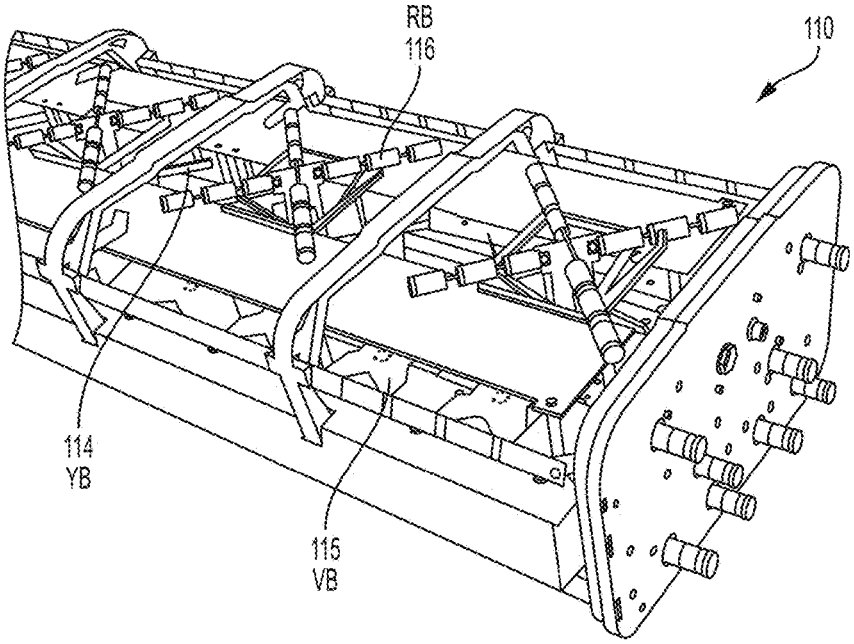
FIG. 1A is a photograph illustrating a multi-band antenna array according to some embodiments of the present disclosure.

Hereinafter, radiating elements (also referred to herein as antennas or radiators) of a multi-band radiating antenna array, such as a cellular base station antenna, are described. In the following description, numerous specific details, including particular horizontal beamwidths, air-interface standards, dipole arm shapes and materials, dielectric materials, and the like are set forth. However, from this disclosure, it will be apparent to those skilled in the art that modifications and/or substitutions may be made without departing from the scope and spirit of the invention. In other circumstances, specific details may be omitted so as not to obscure the invention.

As used hereinafter, "low-band" may refer to a lower operating frequency range for radiating elements described herein (e.g., 694-960 MHz), "high-band" may refer to a higher operating frequency range for radiating elements described herein (e.g., 1695 MHz-2690 MHz), and "mid-band" may refer to an operating frequency range between the low-band and the high-band (e.g., 1427-1511 MHz). A "low-band radiator" may refer to a radiator for such a lower frequency range, a "high-band radiator" may refer to a radiator for such a higher frequency range, and a "mid-band radiator" may refer to a radiator for such a middle frequency range. "Dual-band" or "multi-band" as used herein may refer to arrays including both low-band and high-band radiators. Further, "narrowband" with reference to an antenna may indicate that the antenna is capable of operating and maintaining desired characteristics over a relatively narrow bandwidth, for example, about 100 MHz or less. Characteristics of interest may include the beam width and shape and the return loss. In some embodiments described herein, a mid-band narrowband radiator can cover a frequency range of about 1427 MHz to about 1511 MHz, which, in combination with the low- and high-band radiating elements in the array, can cover almost the entire bandwidth assigned for all major cellular systems.

Embodiments described herein relate generally to mid-band radiators of a multi-band cellular base station antenna and such multi-band cellular base-station antennas adapted to support emerging network technologies. Such multi-band antenna arrays can enable operators of cellular systems ("wireless operators") to use a single type of antenna covering a large number of bands, where multiple antennas were previously required. Such antennas are capable of supporting several major air-interface standards in almost all the assigned cellular frequency bands and allow wireless operators to reduce the number of antennas in their networks, lowering tower leasing costs while increasing speed to market capability.

Antenna arrays as described herein can support multiple frequency bands and technology standards. For example, wireless operators can deploy using a single antenna Long Term Evolution (LTE) network for wireless communications in the 2.6 GHz and 700 MHz bands, while supporting Wideband Code Division Multiple Access (W-CDMA) network in the 2.1 GHz band. For ease of description, the antenna array is considered to be aligned vertically. Embodiments described herein can utilize dual orthogonal polarizations and support multiple-input and multiple-output (MIMO) implementations for advanced capacity solutions. Embodiments described herein can support multiple air-interface technologies using multiple frequency bands presently and in the future as new standards and bands emerge in wireless technology evolution.

Embodiments described herein relate more specifically to antenna arrays with interspersed radiators for cellular base station use. In an interspersed design, the low-band radiators may be arranged or located on an equally-spaced grid appropriate to the frequency. The low-band radiators may be placed at intervals that are an integral number of high-band radiators intervals (often two such intervals), and the low-band radiators may occupy gaps between the high-band radiators. The high-band radiators may be dual-slant polarized and the low-band radiators may be dual polarized and may be either vertically and horizontally polarized, or dual slant polarized.

A challenge in the design of such multi-band antennas is reducing or minimizing the effects of scattering of the signal at one band by the radiating elements of the other band(s). Embodiments described herein can thus reduce or minimize the effect of the low-band radiator on the radiation from the high-band radiators, and vice versa. This scattering can affect the shapes of the high-band beam in both azimuth and elevation cuts and may vary greatly with frequency. In azimuth, typically the beamwidth, beam shape, pointing angle gain, and front-to-back ratio can all be affected and can vary with frequency, often in an undesirable way. Because of the periodicity in the array introduced by the low-band radiators, grating lobes (sometimes referred to as quantization lobes) may be introduced into the elevation pattern at angles corresponding to the periodicity. This may also vary with frequency and may reduce gain. With narrow band antennas, the effects of this scattering can be compensated to some extent in various ways, such as adjusting beamwidth by offsetting the high-band radiators in opposite directions or adding directors to the high-band radiators. Where wide-band coverage is required, correcting these effects may be particularly difficult.

Some embodiments of the present disclosure may arise from realization that antenna arrays including a column of low-band radiator elements (e.g., having an operating frequency range of about 694 MHz to about 960 MHz; also referred to herein as R-band or RB elements) between columns of high-band radiator elements (e.g., having an operating frequency range of about 1695 MHz to about 2690 MHz; also referred to herein as V-band or VB elements) can cover a wider operating frequency range, without substantially affecting performance, by further including one or more mid-band radiator elements having a relatively narrow operating frequency range (e.g., having an operating frequency range of about 1427 MHz to about 1511 MHz; also referred to herein as Y-band or YB elements) interspersed between adjacent RB elements in the column, with each array of RB, VB, and YB elements driven by respective feed networks. For example, two YB radiating elements may be arranged between adjacent ones of a column of RB radiating elements in some embodiments. The inclusion of such YB radiating elements, in combination with the VB radiating elements that are arranged on an opposite sides of the RB radiating elements, may allow for performance over the wider operating frequency range without a space penalty with respect to the size of the antenna array. Narrowband radiating elements and/or configurations as described herein may be implemented in multi-band antenna arrays in combination with antennas and/or features such as those described in commonly-assigned U.S. patent application Ser. No. 14/683,424 filed Apr. 10, 2015, U.S. patent application Ser. No. 14/358,763 filed May 16, 2014, and/or U.S. patent application Ser. No. 13/827,190 filed Mar. 14, 2013, the disclosures of which are incorporated by reference herein.

Figure 1B:
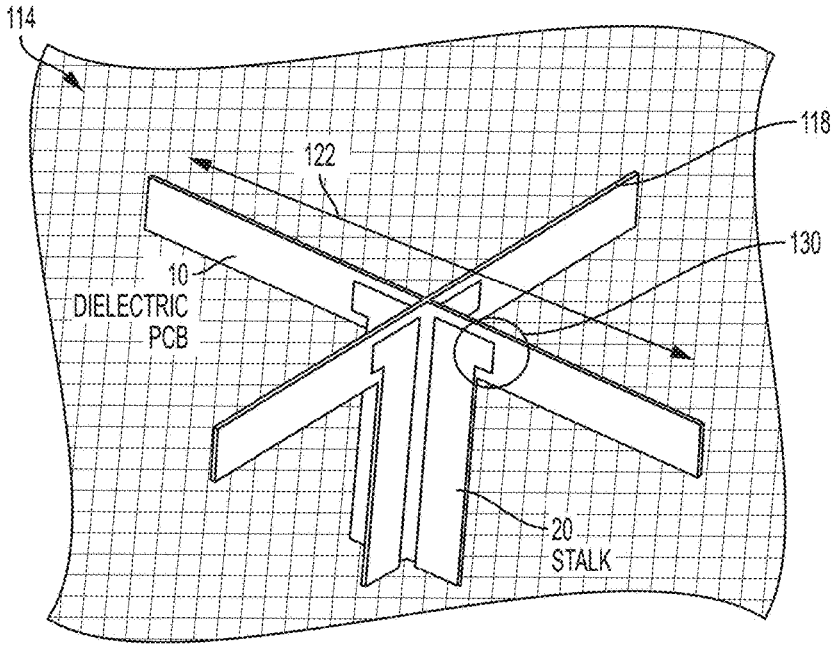
FIG. 1B illustrates a general structure of a mid-band (YB) radiating element for mid-frequency operation that may be used in a multi-band antenna array according to some embodiments of the present disclosure.
Figure 1C:
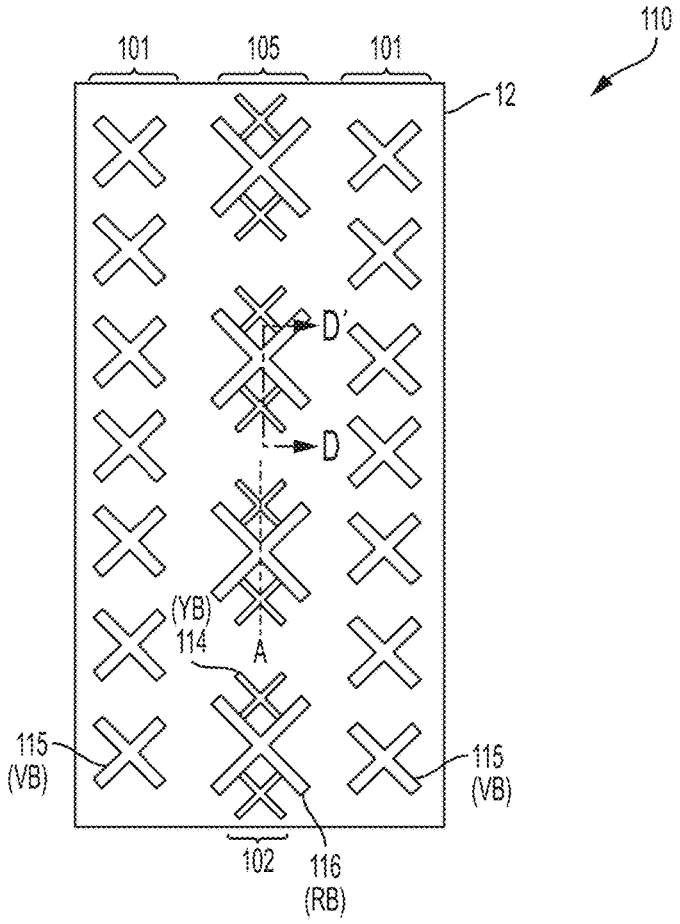
FIG. 1C is a schematic plan view illustrating a multi-band antenna array according to some embodiments of the present disclosure.

FIG. 1A illustrates a multi-band antenna array 110 according to some embodiments of the present disclosure, and FIG. 1C illustrates a layout of the multi-band antenna array 110 of FIG. 1A in plan view. As shown in FIGS. 1A and 1C, the multi-band antenna array includes a reflector 12 (e.g., a ground plane) on which low-band RB radiating elements 116 are arranged to define a column 105. The low-band RB radiating elements 116 are configured to operate at a low-band frequency range of about 694 to 960 MHz. The column 105 of RB radiating elements 116 is arranged between columns 101 of high-band VB radiating elements 115, which are configured to operate at a high-band frequency range of about 1.695 to 2.690 GHz. A column 102 of mid-band YB radiating elements 114, which are configured to operate at a mid-band frequency range of about 1.427 to 1.511 GHz, are positioned between respective RB radiating elements 116 in the column 105. For example, the YB radiating elements 114 and the RB radiating elements 116 may be arranged in a co-linear manner (e.g., with respective centerpoints or stalks aligned along line 'A'), or in a substantially co-linear manner, with multiple YB radiating elements 114 interspersed between RB radiating elements 116 in the same column 102/105.

In the embodiment shown in FIGS. 1A and 1C, the RB radiating elements 116 are low-band (LB) elements positioned with an element spacing of about 265 mm between adjacent RB radiating elements in the column 105. The VB radiating elements 115 are high-band (HB) elements positioned with an element spacing of about 106 mm between adjacent VB radiating elements in the column 101. The YB radiating elements 114 are narrowband elements positioned with an element spacing of about 132.5 mm between adjacent YB elements in the column 102. In the examples of FIGS. 1A and 1C, two YB elements 114 are positioned between adjacent ones of the RB elements 116 in the column 105, such that the YB elements 114 are located centrally in the array with stalks that are aligned with those of the RB radiating elements 116. Column 102 defined by the YB elements 114 may be laterally spaced by about 80 mm from columns 101 defined by the VB elements 115 on opposite sides thereof. However, it will be understood that the array configuration and element spacings of FIGS. 1A and 1C are illustrated by way of example, and that embodiments of the present disclosure are not limited thereto. For example, in some embodiments, the vertical columns 101 and 105 of high-band elements 115 and low-band elements 116 may be spaced at about one-half wavelength to one wavelength intervals.

As shown in FIG. 1C, the radiating elements 114, 115, and/or 116 may be implemented as a pair of crossed dipoles. The crossed dipoles may be inclined at 45° so as to radiate slant polarization. The crossed dipoles may be implemented as bow-tie dipoles or other wideband dipoles. In particular, in the example radiating antenna array 110 of FIG. 1C, the lower band radiating elements 116 are implemented as cross dipole elements arranged in a vertical column 105 on reflector 12. Mid-band radiating elements 114 and high-band radiating elements 115 are implemented as high impedance cross dipole elements and are arranged in a vertical column 102 and vertical columns 101, respectively. The vertical columns 101 are arranged on the reflector 12 on opposite sides of the vertical column 105. As noted above, the low-band RB radiators 116 are configured to operate in the 694-960 MHz band, the high-band VB radiators 115 are configured to operate in the 1.7-2.7 GHz (1695-2690 MHz) band, and the narrowband YB radiators 114 are configured to operate in the 1.4-1.5 GHz (1427-1511 MHz) band. The low-band RB radiators 116 may provide a 65 degree beamwidth with dual polarization in some embodiments. Such dual polarization may be required for base-station antennas. While specific configurations of dipoles are shown, other dipoles may be implemented using metal tubes or cylinders or as metalized traces on a printed circuit board, for example. Other types of radiating elements (e.g., patch radiators) may also be used.

Figure 1D:
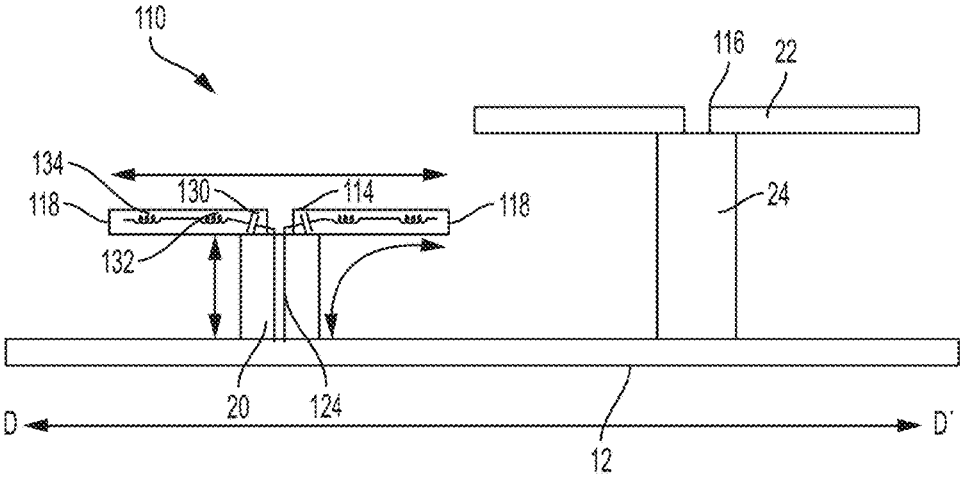
FIG. 1D is a schematic side view of the low-band (RB) and mid-band (YB) elements of a multi-band antenna array according to some embodiments of the present disclosure.

FIG. 1D is a side view relative to line D-D' of FIG. 1C that schematically illustrates a low-band (RB) element 116 and a mid-band (YB) element 114 of the antenna array 110. As shown in FIG. 1D, the low-band RB radiating element 116 may include opposing arm segments 22 that define a half-wave dipole. The arm segments 22 may radially extend from a stalk defined by a feed board 24 that protrudes from the planar reflector or ground plane 12. In some embodiments, each dipole arm segment 22 may be approximately one-quarter to one-half wavelength long with respect to the low-band operating frequency to define first and second half-wave dipoles. In other embodiments, opposing arm segments 22 of the low-band RB radiating element 116 may define a first dipole and second, extended dipole configured in a crossed-dipole arrangement with crossed center feed.

The dipole antennas may be connected to an antenna feed by a center feed provided by the feed board 24. Additionally, the feed board 24 may be approximately one-quarter wavelength long with respect to the low-band operating frequency. The mid-band YB radiating element 114 includes opposing arm segments 118 that define a half-wave dipole. The arm segments 118 radially extend from a stalk 20 defined by feed board substrate that protrudes from the planar reflector or ground plane 12. Each dipole arm 118 may be approximately one-quarter wavelength long with respect to the narrowband operating frequency. As described in detail below, each arm segment 118 may include a capacitor 130 that couples one or more inductors 132, 134 on the arm segment 118 to the stalk 20.

FIG. 1B illustrates the structure of the mid-band (YB) radiating element 114 in greater detail. As shown in FIGS. 1B and 1D, the YB radiating element 114 includes an elongated stalk 20 that suspends elongated arm segments 118 above a mounting surface (e.g., a planar reflector or ground plane 12). The arm segments 118 radially extend from an end of the stalk 20 that is opposite to the planar reflector 12, such that the arm segments 118 are parallel to the planar reflector 12. The opposing arm segments 118 together define an arm length 122 between ends thereof. Opposing ones of the arm segments 118 define first and second dipole antennas in a crossed dipole arrangement positioned at one end of the stalk 20. A cross-pole ratio (CPR) may define the amount of isolation between orthogonal polarizations of signals transmitted by each of the first and second dipole antennas.

Referring to FIGS. 1B and 1D, the stalk 20 may suspend the arm segments 118 above the reflector 12 by a length based on the desired narrowband operating frequency of the YB radiating element 114 in some embodiments. For example, the feed board defining the stalk 20 may be approximately one-quarter wavelength long with respect to the narrowband operating frequency or frequency range. The feed board may include feed lines 124 that connect the first and second dipole antennas to an antenna feed.

Portions of the stalk 20 and arm segments 118 may be implemented by a unitary member, e.g., a single piece printed circuit board (PCB), in some embodiments. In the embodiment of FIG. 1B, the stalk 20 includes two interlocked, crossed printed circuit boards (PCB) 10 having respective metal segments thereon. The PCBs 10 are T-shaped, and the first and second dipole antennas are defined by the metal segments on opposing ones of the elongated arm segments 118 in a cross dipole arrangement, as shown in greater detail in FIGS. 3A and 5A. One printed circuit board implements the connection between the first dipole and the antenna feed, and the other printed circuit board implements the connection between the second dipole and the antenna feed. The antenna feed may be a balun, of a conventional configuration. Metal layers 121 on opposing sides of the PCB 10 may define capacitors 130 that couple respective arm segments 118 to the stalk 20, as described in detail below.

Simulation and experimental data for an example multi-band radiating array including a column of low-band RB radiating elements between columns of high-band VB radiating elements and mid-band YB radiating elements interspersed in the column of RB radiating elements will be described below with reference to FIGS. 2A-10C. The example multi-band radiating array may thus have a configuration similar to the embodiment of FIG. 1C. In particular, FIGS. 2A, 3A, 4A, 5A, and 5C-5E illustrate example YB element structures, FIGS. 2B, 3B, 4B, and 5B illustrate simulation data for arrays including the example YB element structures, and FIGS. 6-10C illustrate measurement data for arrays including the example YB element structures.

Figure 2A:
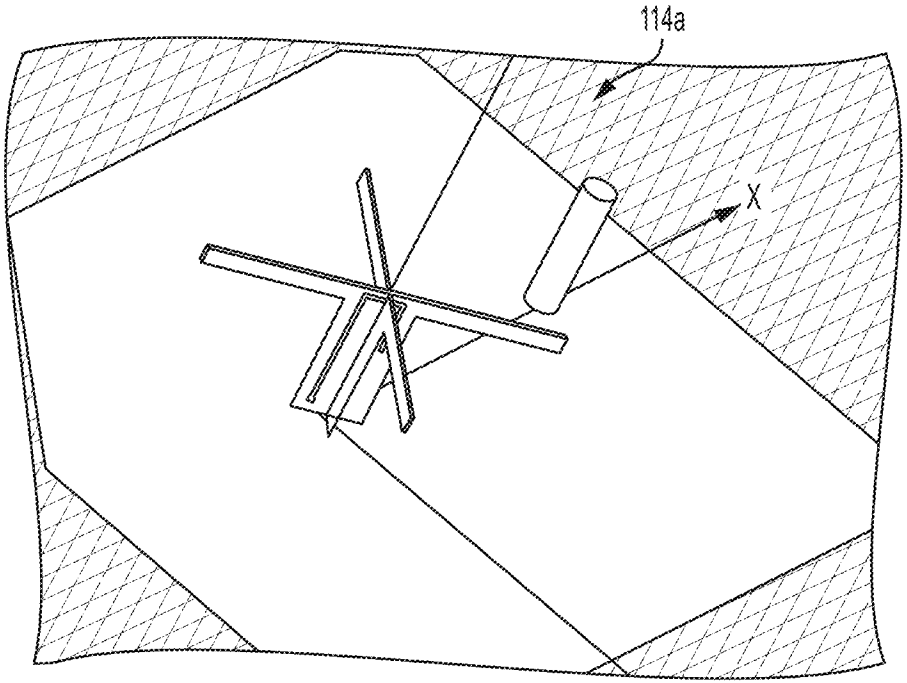
FIG. 2A illustrates an example of a mid-band radiating element according to some embodiments of the present disclosure.

FIG. 2A illustrates an example YB radiating element 114*a* for modeling effects on other radiating elements of a multi-band antenna array according to some embodiments of the present disclosure. As noted above, the addition of radiating elements with different bands or frequencies of operation into a multi-band antenna array may degrade performance of the remaining radiating elements of the array. In particular, the addition of the YB radiating elements 114 into a multi-band antenna array 110 including a column 105 of RB radiating elements 116 between columns 101 of VB radiating elements 115, such as shown in FIG. 1C, may degrade performance of one or both of the RB radiating elements 116 and the VB radiating elements 115. Conversely, the VB radiating elements 115 may also degrade the performance of the YB radiating elements 114.

Figure 2B:
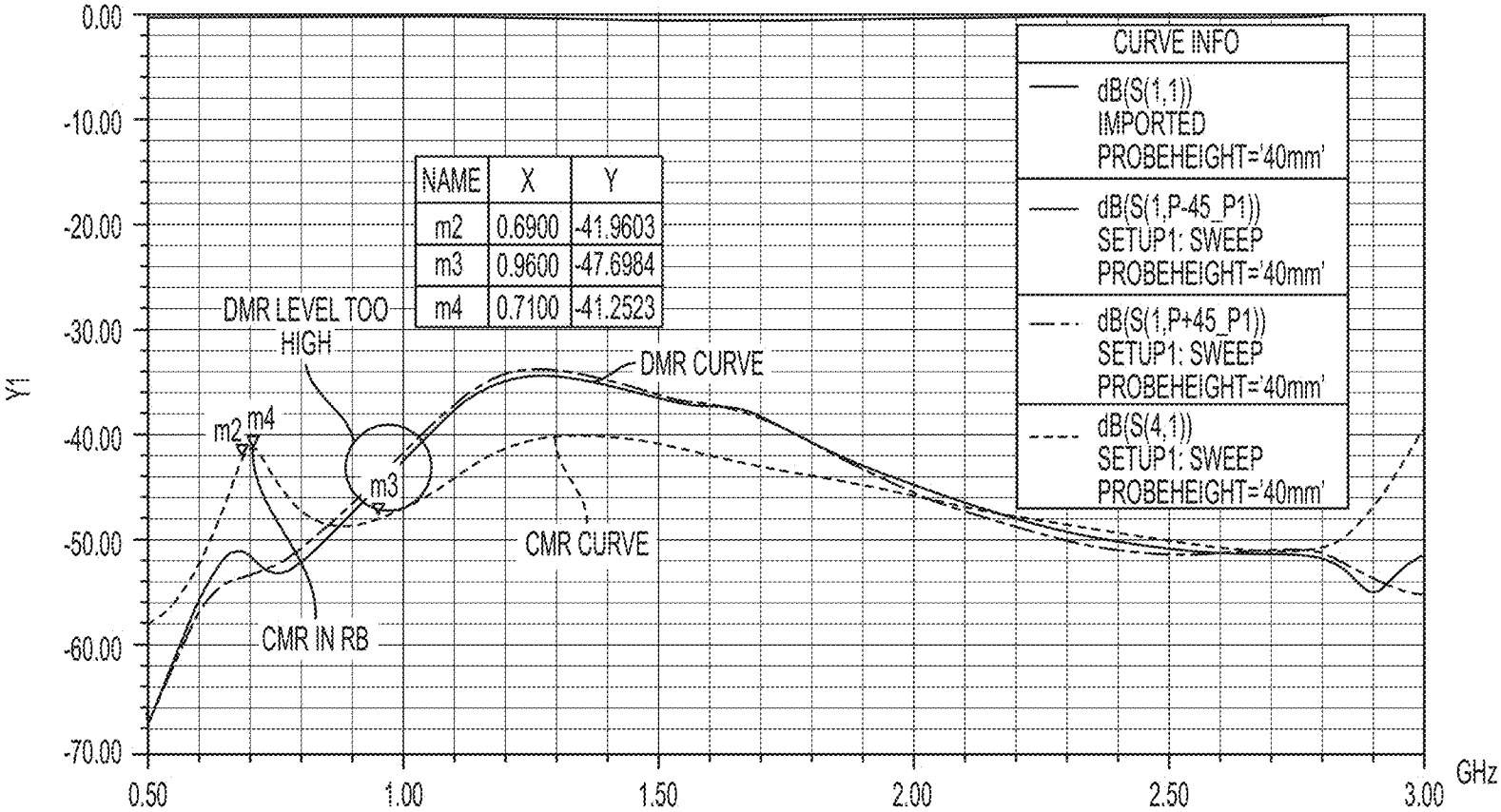
FIG. 2B is a graph illustrating common mode resonance (CMR) and differential mode resonance (DMR) effects of the mid-band (YB) radiating element of FIG. 2A in a multi-band antenna array according to some embodiments of the present disclosure.

FIG. 2B is a graph illustrating common mode resonance (CMR) and differential mode resonance (DMR) effects of the YB radiating element 114*a* of FIG. 2A in a multi-band antenna array including columns of RB radiating elements between columns of VB radiating elements. AYB element 114*a* with selected height (e.g., stalk length) and arm length may exhibit return loss (RL) resonance at around 1.45 GHz, and thus, may provide acceptable impedance bandwidth. However, FIG. 2B illustrates that the inclusion of such a YB element 114 in the multi-band antenna array may result in a local peak in CMR at about 710 MHz, which is in the low-band operating frequency range (e.g., 694-960 MHz) corresponding to operation of the RB radiating elements. Embodiments of the present disclosure may thus move or shift this local CMR peak into a frequency range that is below the low-band operating frequency range. For example, embodiments described herein may move the 710 MHz CMR peak to a frequency of about 650 MHz or less. This may be achieved, for example, by including inductors on the arm segments, as discussed below with reference to FIGS. 3A and 3B. Also, DMR of around −42 dB may be present towards the upper end of the low-band operating frequency range (e.g., at about 1 GHz). This DMR can introduce a large resonance on RL and ISO for the RB elements, and, thus, a significant impact on performance of the RB elements. However, if DMR level were reduced to lower than about −54 dB, the impact of DMR on RL and ISO for the RB elements may be reduced or removed (which may result in a smoother curve).

Figure 3A:
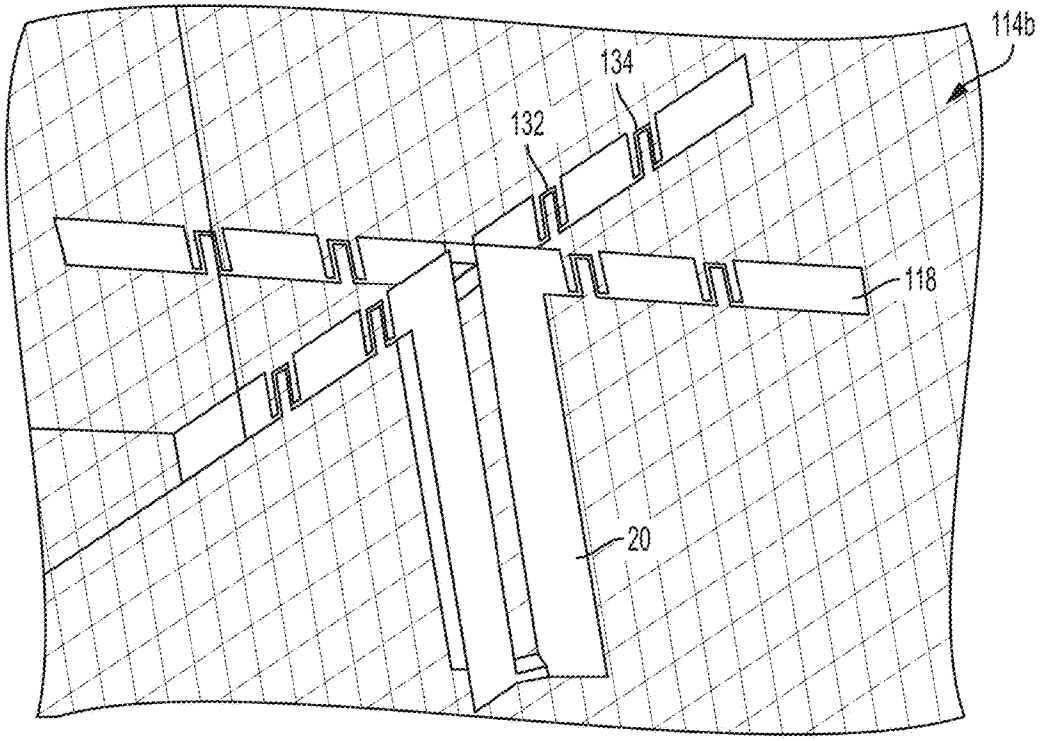
FIG. 3A illustrates a mid-band (YB) radiating element including two inductors on an arm segment thereof according to some embodiments of the present disclosure.

FIG. 3A illustrates a YB radiating element 114*b* including two inductors on an arm segment thereof according to some embodiments of the present disclosure. As shown in FIG. 3A, two inductors 132, 134 are included along the length of each arm segment 118 of the YB radiating element 114*b*. The inclusion of the inductors 132, 134 may improve the impact of CMR on the operating frequency ranges of the VB and RB radiating elements in the array.

Figure 3B:
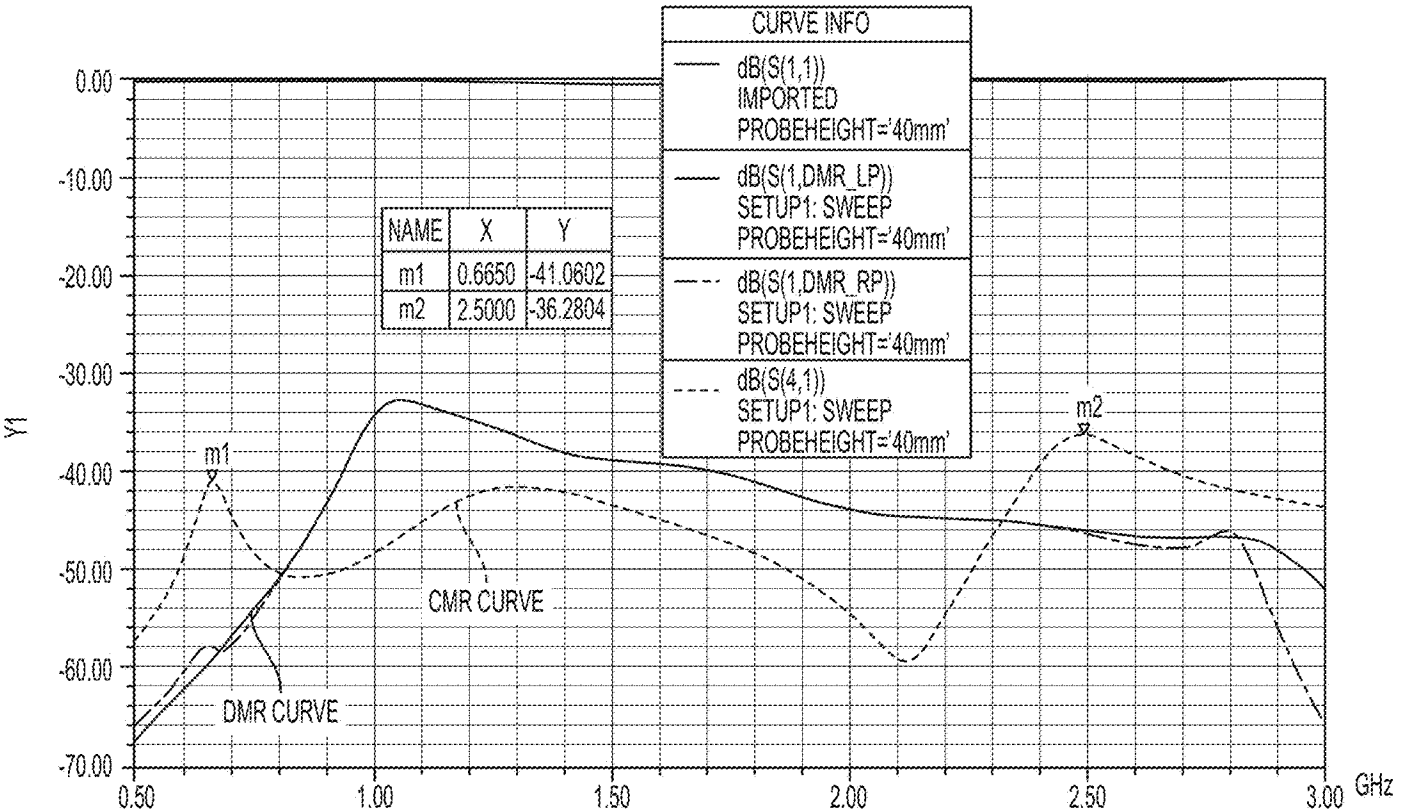
FIG. 3B is a graph illustrating CMR and DMR effects of the mid-band (YB) radiating element of FIG. 3A in a multi-band antenna array according to some embodiments of the present disclosure.

FIG. 3B is a graph illustrating CMR and DMR effects of the YB radiating element 114*b* of FIG. 3A in the example multi-band antenna array. As shown in FIG. 3B, with the two inductors 132, 134 on the arm segment 118, the local CMR peak (previously at about 710 MHz in FIG. 2B) is moved to a frequency range below and outside of the low-band operating frequency range (694-960 MHz), for example, to about 665 MHz. The CMR peak can be moved to still lower frequencies by increasing the inductance values of the inductors 132, 134, where the inductor 132 that is closer or proximate to the feed line (provided by the stalk/feed board 20) may have a greater influence on CMR than the inductor 134 that is distal from the stalk/feed board 20. However, at the upper end of the frequency range illustrated in FIG. 3B, CMR was moved from above 3 GHz (in FIG. 2B) to about 2.5 GHz, that is, into the high-band operating frequency range (1695-2690 MHz) corresponding to operation of the VB radiating elements. As noted above, CMR can be moved towards lower frequencies, and the CMR level may be increased, as the inductance values of the inductors 132, 134 are increased. FIG. 3B further illustrates that the DMR level in the low-band operating frequency range (e.g., at about 1 GHz) is around −35 dB, which may introduce a large resonance on RL and ISO (and thus, a significant impact on performance) for the RB elements. As such, a capacitor positioned between the stalk 20 and arm segments 118 may significantly lower DMR in the low-band operating frequency range, as discussed below with reference to FIGS. 4A-4B.

Figure 4A:
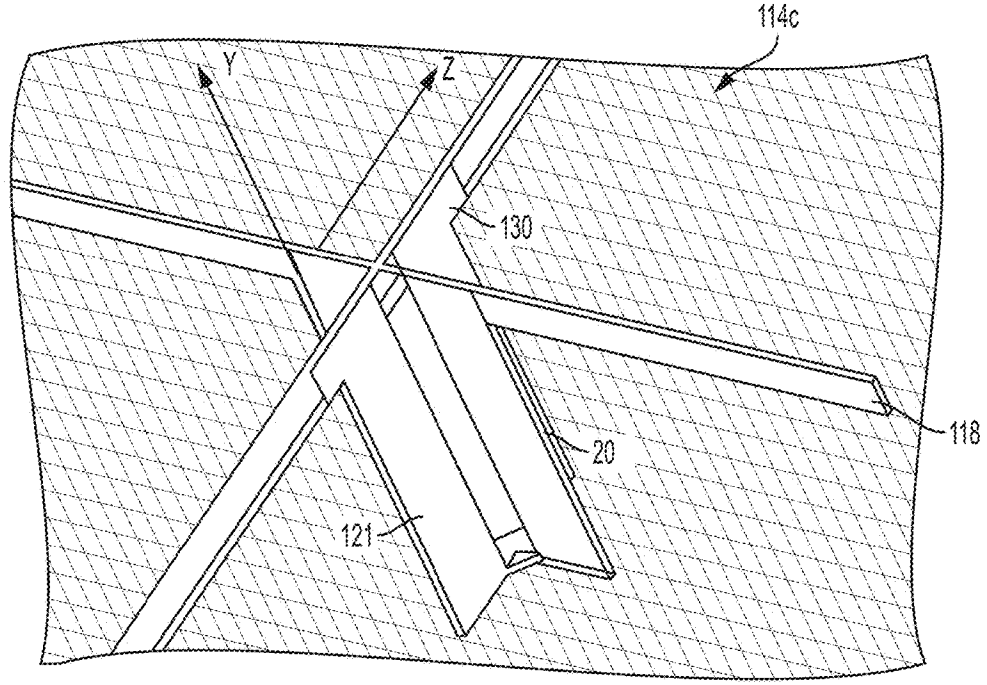
FIG. 4A illustrates a mid-band (YB) radiating element including a capacitor between a stalk and an arm segment thereof according to some embodiments of the present disclosure.

FIG. 4A illustrates a YB radiating element 114*c* including a capacitor between a stalk and an arm segment thereof according to some embodiments of the present disclosure. As shown in FIG. 4A, capacitors 130 are positioned between the stalk 20 and the arm segments 118 of the YB radiating elements 114*c*. In the example YB radiating element 114*c* of FIG. 4A, the capacitors 130 are implemented by overlapping metal layers 121 on opposite sides of the PCB portions that defines the stalk 20 and arm segments 118.

Figure 4B:
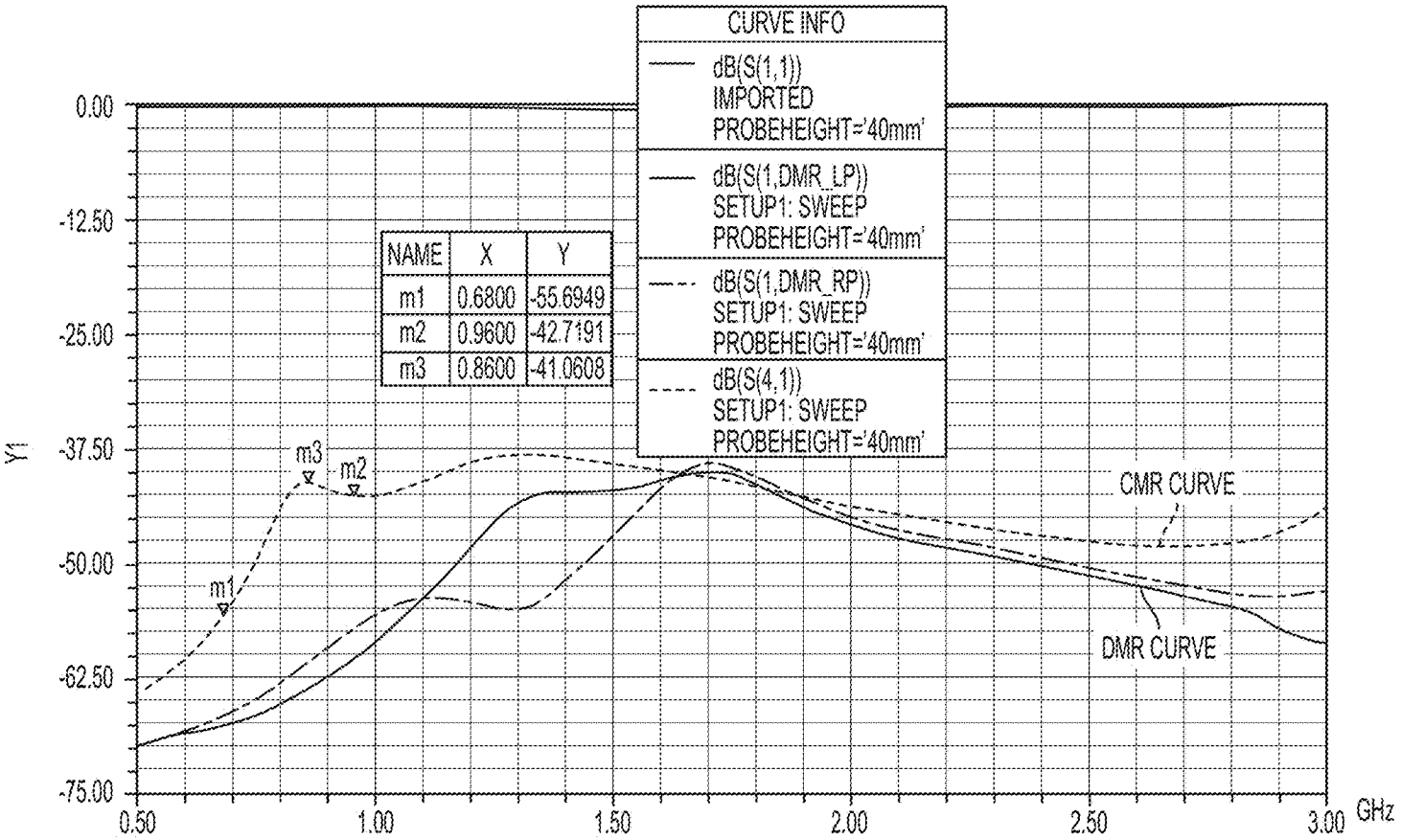
FIG. 4B is a graph illustrating CMR and DMR effects of the mid-band (YB) radiating element of FIG. 4A in a multi-band antenna array according to some embodiments of the present disclosure.

FIG. 4B is a graph illustrating CMR and DMR effects of the YB radiating element 114*c* of FIG. 4A in a multi-band antenna array according to some embodiments of the present disclosure. In particular, as shown in FIG. 4B, adding the capacitors 130 to couple the arm segments 118 to the stalk 20 may move or shift CMR to higher frequencies (e.g., from about 710 MHz to about 860 MHz). As such, a design including two inductors and a capacitor on each arm segment 118 may be expected to have CMR in the low-band operating frequency range (694-960 MHz). Also, adding the capacitors 130 to couple the arm segments 118 to the stalk 20 appears to reduce DMR level from about 42 dB to about 57 dB (at 1 GHz), which may reduce the impact of DMR on low-band performance of the array. From measurement in a vector network analyzer (VNA), the large resonance on RL and ISO for the RB elements (as exhibited in the two-inductor embodiment of FIGS. 3A-3B) was not present. As such, adding capacitors 130 between the stalk 20 and the arm segments 118 may help offset or counteract DMR introduced by the inclusion of the YB radiating elements 114*c* in the array 110.

Figure 5A:
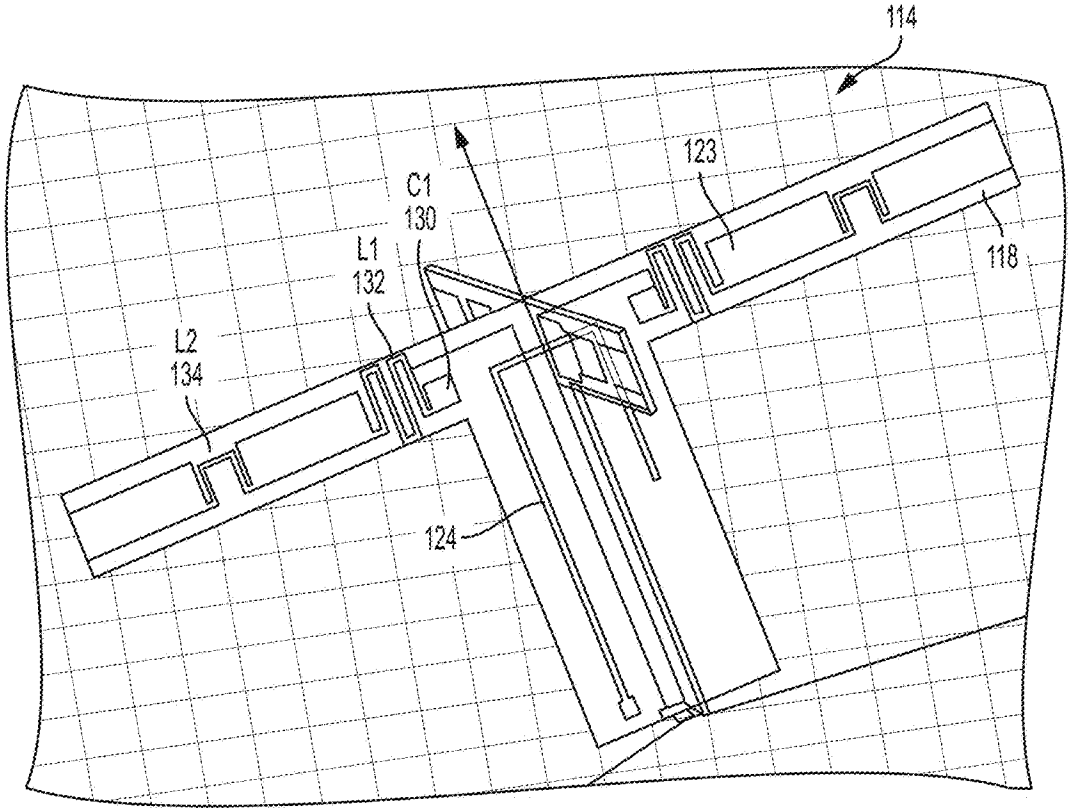
FIG. 5A illustrates a mid-band (YB) radiating element including a capacitor and two inductors on an arm segment thereof according to some embodiments of the present disclosure.
Figure 5B:
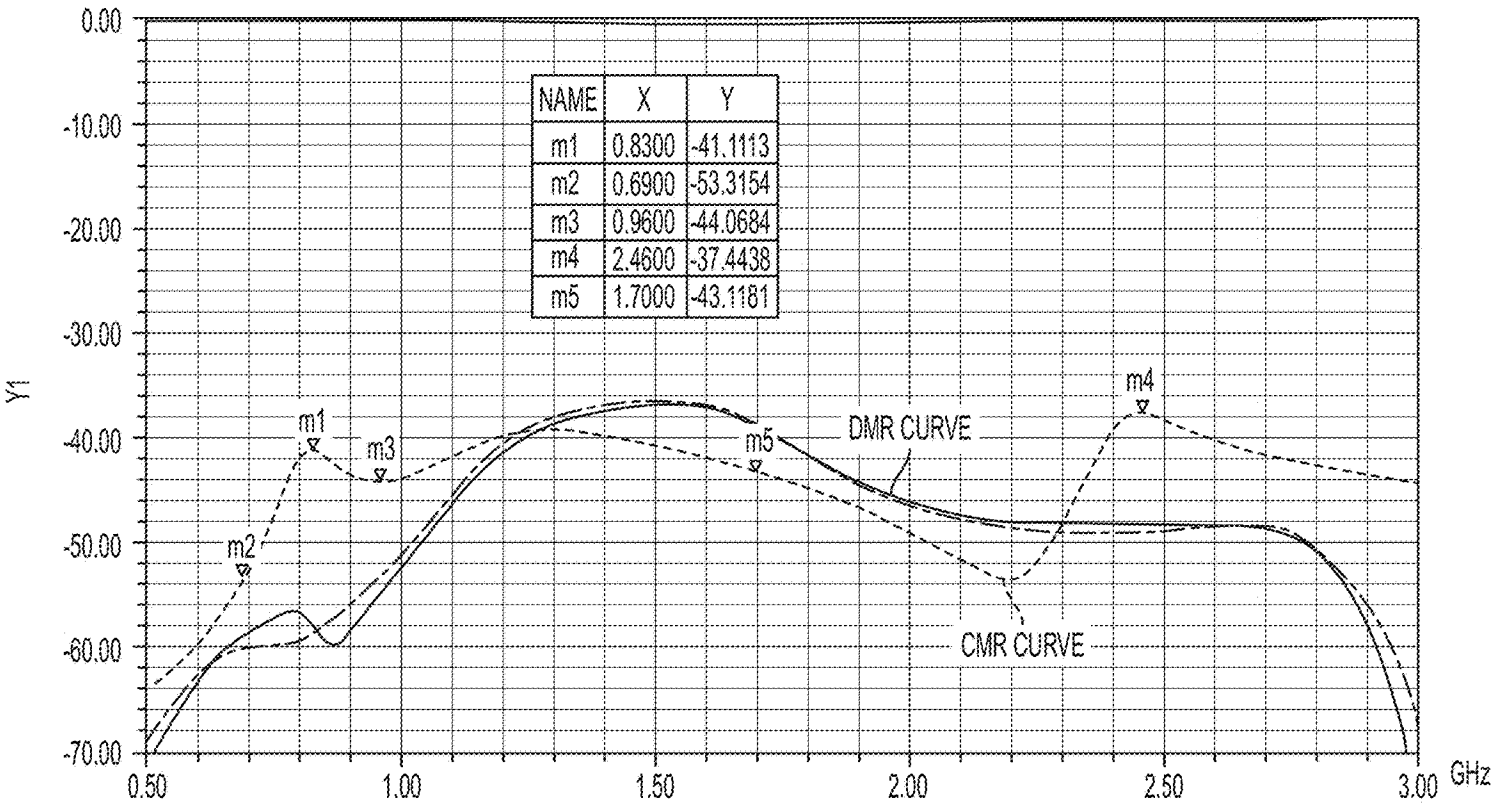
FIG. 5B is a graph illustrating CMR and DMR effects of the mid-band (YB) radiating element of FIG. 5A in a multi-band antenna array according to some embodiments of the present disclosure.
Figure 5C:
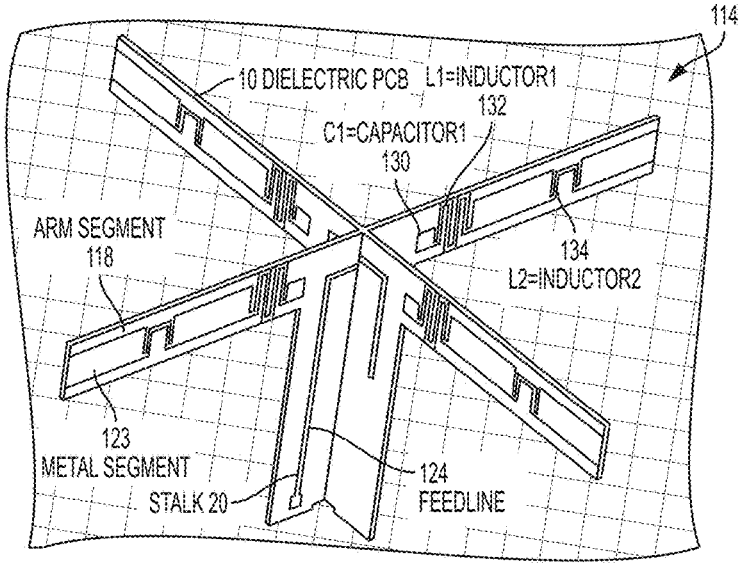
FIG. 5C is an alternate view of the mid-band (YB) radiating element of FIG. 5A according to some embodiments of the present disclosure.
Figure 5D:
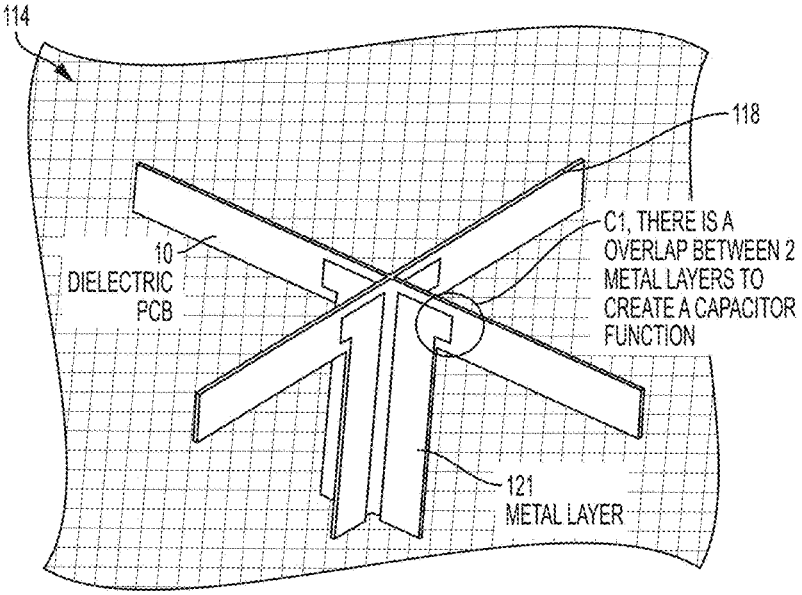
FIG. 5D is another alternate view of the mid-band (YB) radiating element of FIG. 5A according to some embodiments of the present disclosure.
Figure 5E:
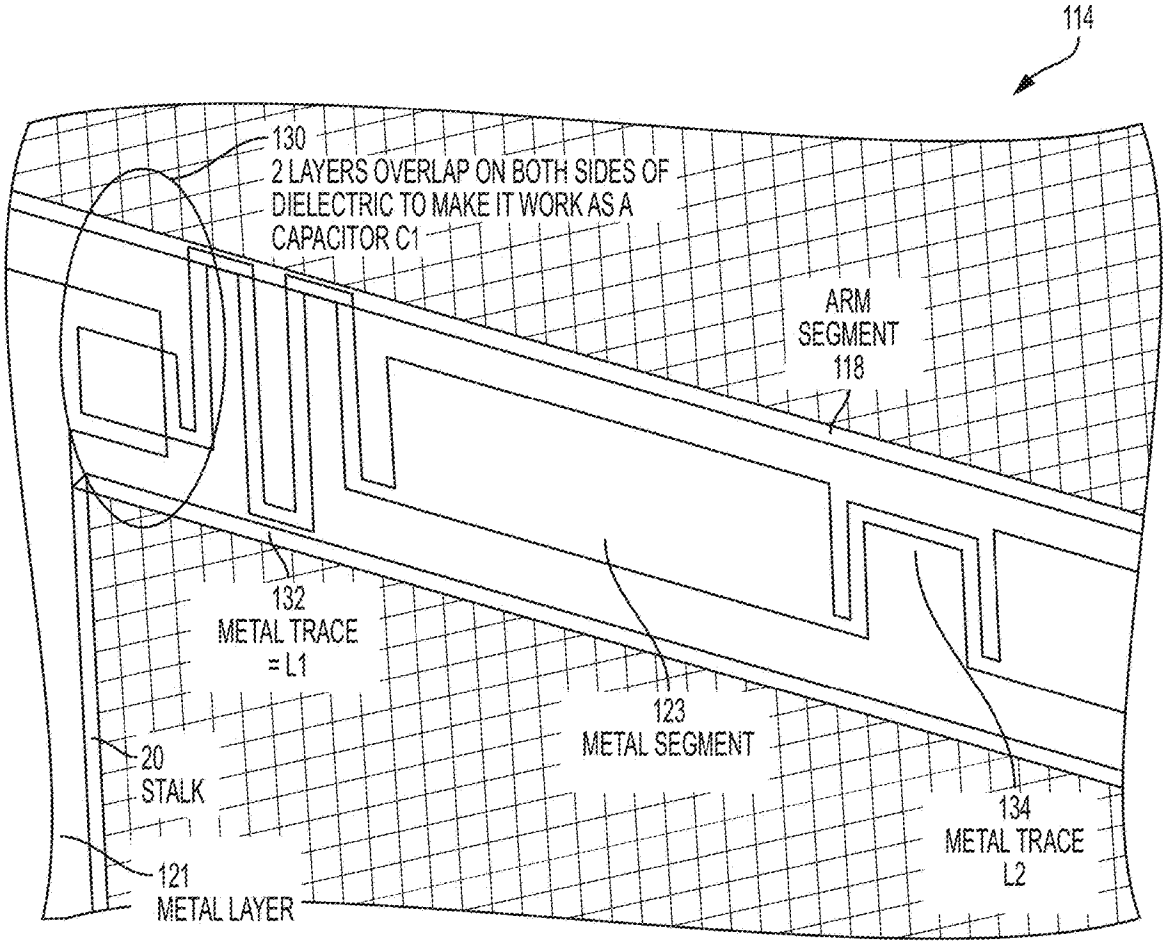
FIG. 5E is an enlarged view illustrating the arm segment of the mid-band (YB) radiating element of FIG. 5A.

FIGS. 5A, 5C, and 5D are multiple views of a YB radiating element 114 including a capacitor 130 and two inductors 132 and 134 extending along respective arm segments 118 thereof according to some embodiments of the present disclosure. FIG. 5E is an enlarged view illustrating the arm segment 118 of the YB radiating element 114 in greater detail.

As shown in FIGS. 5A and 5C-5E, the stalk 20 and arm segments 118 are implemented by two T-shaped printed circuit boards (PCBs) 10 in a crossed arrangement. The portions of the PCBs 10 forming the base sections of each "T" define the stalk 20, while the portions of the PCBs 10 forming the upper, laterally-extending portions of the "T" define the arm segments 118. The PCBs 10 include a dielectric coating on surfaces thereof. A capacitor 130, implemented by overlapping metal layers 121, C1 on opposite surfaces of the dielectric PCB 10, extends between the stalk 20 and a respective arm segment 118.

In particular, as shown in the enlarged view of FIG. 5E, a metal layer 121 having an inverted or upside-down L-shape is provided on one side of the base portion of the PCB 10 that defines the stalk 20. The metal layer 121 extends along the stalk 20 and extends partially onto on one side of the upper, laterally extending portion of the PCB 10 that defines the arm segment 118. A metal layer C1 is also provided on an opposing side of the upper, laterally extending portion of the PCB 10 defining the arm segment 118, such that the metal layer 121 and C1 overlap. The overlapping metal layers 121 and C1, with the portion of the dielectric PCB 10 therebetween, define a capacitor 130 that couples the metal segments 123 extending along the arm segment 118 to the stalk 120.

The respective capacitors 130 coupling each of the arm segments 118 to the stalk 20 may reduce the impact of DMR (due to the YB radiating elements 114) on the RB radiating elements of the array. In contrast, capacitors may conventionally be used in radiating elements to move or shift CMR towards higher frequencies, as the capacitors may act as open circuits at lower band frequencies (preventing the arm segments 118 and feed board 20 from operating as a monopole). As such, RL, ISO, and/or beamwidth patterns of the array in the low-band may not be significantly impacted by DMR introduced by the YB radiating elements 114.

Still referring to FIGS. 5A and 5C-5E, the capacitor 130 serially couples the inductors 132 and 134, which are spaced apart from one another along the length of the respective arm segments 118, to the stalk 20. In the examples of FIGS. 5A and 5C-5E, the inductors 132 and 134 are implemented by metal traces L1 and L2 on the PCBs 10. The metal traces L1 defining the inductor 132 (illustrated as meandering traces L1) are positioned proximate the stalk 20, and serially couple respective capacitors 130 to portions of respective metal segments 123 extending along the length of arm segments 118. The metal traces L2 defining the inductor 134 extend between portions of the respective metal segments 123 distal from the stalk 20, where the metal segments 123 on opposing arm segments 118 define first and second dipole antennas in a crossed dipole arrangement. As such, the capacitor 130, inductor 132, and inductor 134 are serially connected (also referred to as a CLL arrangement) between the stalk 20 and the metal segments 123 defining the dipole antennas on the arm segments 118.

The combination of the capacitor 130 and the inductors 132 and 134 on the respective arm segments 118 may further improve the CMR with respect to the high-band performance of the array. The positioning of the inductors 132 and 134 on and/or along a length of the respective arm segments 118 may also improve performance. For example, the inductance provided by the inductors 132 proximate the stalk 20 may have a greater impact on CMR than the inductors 134 distal from the stalk 20. The inductors 134 distal from the stalk 20 may thus have a lower inductance than the inductors 132 closer to the stalk in some embodiments. Also, the closer the inductors 132 and 134 are to the top end of the stalk 20, the lower the CMR may be moved or shifted in the frequency range. Thus, in some embodiments, the respective capacitors 130 coupling each of the arm segments 118 to the stalk 20 may be used in conjunction with the inductors 132 and 134 to move or shift CMR (due to the YB elements 114) to a lower frequency range, such that the CMR impact on the performance of the array in the high-band operating frequency range may be more acceptable.

In addition to arm segments 118 including the serially-connected capacitor 130 (which may reduce DMR impact on the low-band RB elements) and inductors 132 and 134 (which may reduce CMR impact on the high-band VB elements) shown in FIGS. 5A and 5C-5E, a YB radiating element 114 according to embodiments of the present disclosure may further include additional features that may reduce CMR impact on the low-band performance. For example, in some embodiments a non-conductive spacer element (generally referred to herein as a spacer) may be provided beneath the stalk 20 of the YB element 114, which may help reduce the impact of CMR on the low-band performance. In particular, the spacer can increase the effective length of the feed board/stalk 20, thereby moving or shifting CMR to a frequency that is below or outside of the low-band operating frequency range of the RB elements. In some embodiments, spacer of about 3 mm in height may be used. In addition, the ground area of the feed board/stalk 20 of the YB element 114 may be cut or otherwise reduced, to reduce coupling between the YB element 114 and the reflector or ground plane 12. Additionally or alternatively, an opening or hole may be cut into the reflector/ground plane 12 to shape a 'window' around the stalk feed board/stalk 20 of the YB element 114, similarly reducing coupling with the reflector 12. As such, while the YB elements 114 may introduce CMR at both the low and high-bands, the CMR impact on performance of the array in the low-band may be reduced. These and/or other features to address CMR impact on low-band performance may therefore allow for a greater focus on reducing CMR impact on the high-band performance.

FIG. 5B is a graph illustrating CMR and DMR effects of the YB radiating element of FIG. 5A in a multi-band antenna array according to some embodiments of the present disclosure. As mentioned above, CMR and/or DMR may be introduced when adding radiating elements having an operating frequency band that differs from those of the existing radiating elements in an array. For multi-band radiating arrays including YB elements 114 in accordance with embodiments of the present disclosure, measurement in far field test range indicated the presence of CMR in the high-band operating frequency range at about 1880 MHz and at about 2650 MHz; however, the CMR at 2650 MHz did not appear to significantly impact the high-band radiating pattern of the array. In the radiating pattern, it appears that CMR of about 15 dB may be present at about 850 MHz at the cross-pole ratio at bore sight. Also, the CMR impact on low-band RL and ISO indicated a peak in ISO (albeit not sharp as the DMR curve); this CMR may degrade ISO from 22 dB to around 18 dB.

It is noted that the CMR at about 1880 MHz may not appear in some simulations; however, when tuning in FF, it was observed that an increase in the inductance of the first inductor 132 or the second inductor 134, or an increase in the capacitance of the capacitor 130, may move or shift this CMR at the lower end (e.g., 1880 MHz) of the high-band operating frequency range to a lower frequency. Some simulations also indicated that the CMR level at the lower end of the high-band operating frequency range would be shifted to a lower frequency, that is, the simulated CMR level matched the measured pattern over the high-band.

Further tuning revealed that, while an increase in the inductance of the first inductor 132 can result in a shift in the CMR at 1880 MHz to a lower frequency, the CMR at 2650 MHz was likewise shifted to a lower frequency (thus moving this CMR further into the high-band, at around 2460 MHz), which was matched or confirmed with some simulation results. As the inductance values of the first inductor 132 and/or the second inductor 134 are increased (with increases in inductor 132 closest to the stalk 20 having a greater impact), CMR at the lower end of the high-band operating frequency range may be moved below or outside of the high-band operating frequency range, but the azimuth bandwidth of the VB elements at about 2460 MHz may be quickly widened. Also the low-band ISO may be degraded and moved to a lower frequency.

Figure 6:
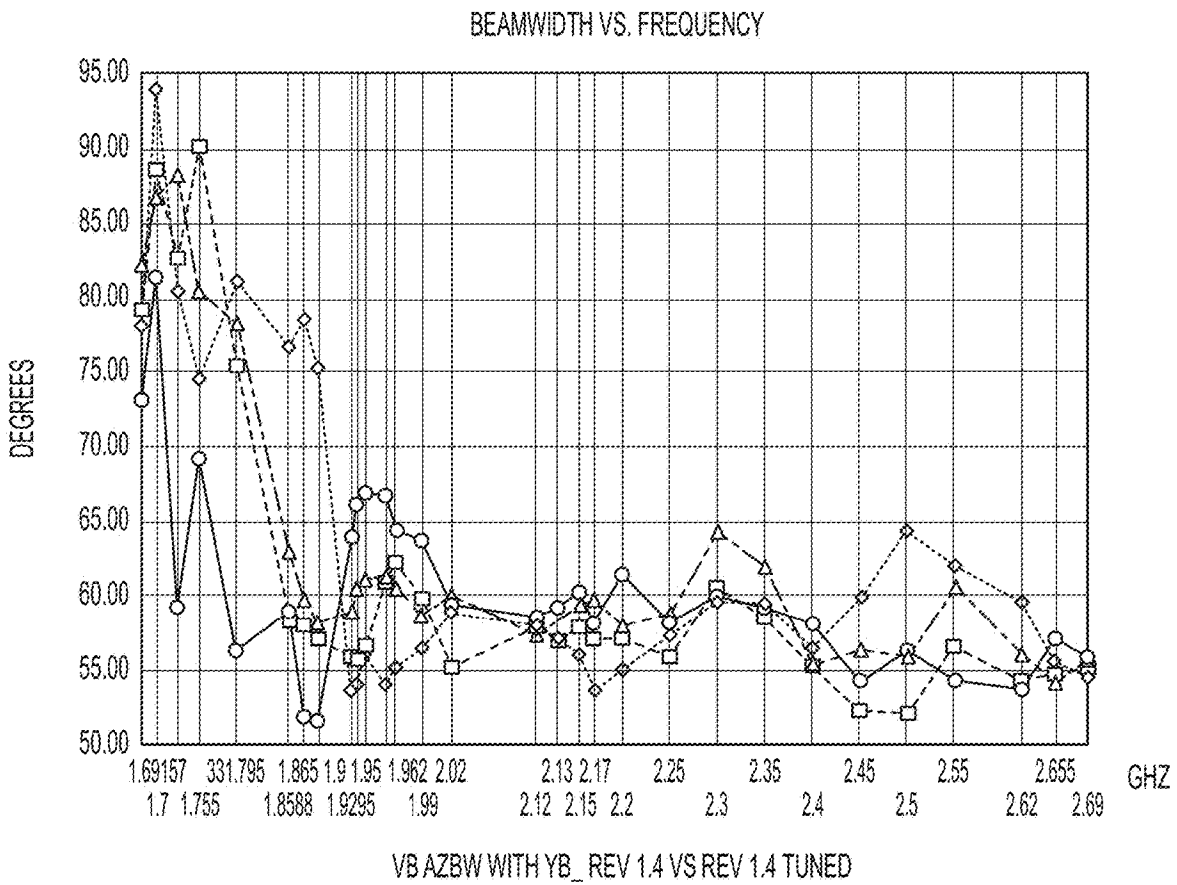
FIGS. 6 and 7 are graphs illustrating azimuth beamwidth vs. frequency of a multi-band antenna array including mid-band (YB) radiating elements according to some embodiments of the present disclosure over the higher operating frequency range of the high-band (VB) radiating elements.
Figure 7:
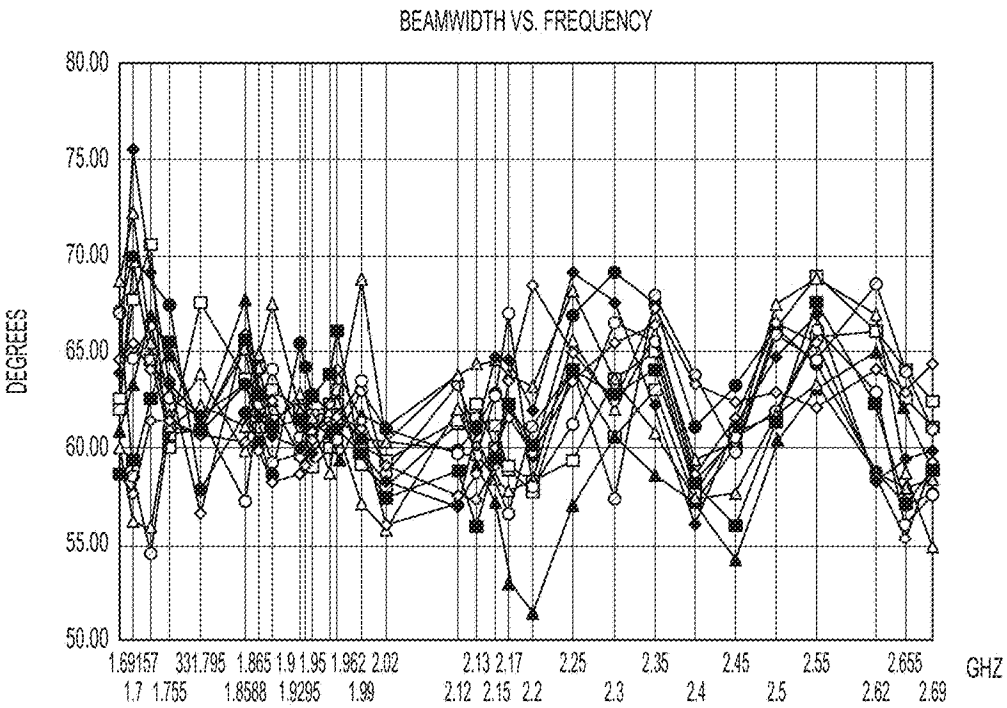

FIGS. 6 and 7 are graphs illustrating azimuth beamwidth vs. frequency of a multi-band antenna array including YB radiating elements according to some embodiments of the present disclosure over the high-band VB operating frequency range (e.g., 1695 MHz-2690 MHz). In particular, FIGS. 6 and 7 illustrate effects of tuning the capacitor 130 and the inductors 132 and 134 of the YB radiating elements 114 on the azimuth beamwidth of the array, where the VB elements are arranged in two columns, laterally spaced by 160 mm, on opposite sides of a column including the YB elements 114 interspersed between RB elements. Performance was measured using inductance values of 12 nH, 15 nH, and 22 nH for the inductors 132 and/or 134; however, while the azimuth beamwidth was not significantly changed at the lower end of the high-band operating frequency range, azimuth beamwidth was significantly widened at the upper end of the high-band operating frequency range, even up to 80 degrees. If the capacitance value of capacitor 130 or the arm length 22 of the YB elements 114 were instead increased, DMR may be expected to have a bigger impact on the azimuth beamwidth, since DMR level may be increased with longer arm length and/or higher capacitance values. Some bench test data also indicated a small spike and slight degradation on low-band RL and ISO. With this trade off, it is evident that azimuth beamwidth over the high-band may be acceptable based on element tuning described herein.

Accordingly, FIG. 7 illustrates azimuth beamwidth for an array having YB radiating elements 114 including a larger 6 mm length*7 mm width capacitor C1 130 (increased from 3 mm length*3 mm width) coupling respective arm segments 118 thereof to respective stalks 20 thereof, and a 6 nH inductor 132 defined by traces L1 on each arm segment 118 to couple the capacitor 130 to the metal segments 123 defining portions of each dipole extending along the arm segments 118. A 3 mm-tall spacer was also arranged at an end of the stalk 20 opposite the arm segments 118. As shown in FIG. 7, high-band performance of the array was improved based on the increased capacitance and inductance values for the capacitor 130 and the inductor 132. The combination of the capacitor 130 and inductor 132 can also reduce DMR level to reduce or avoid low-band RL and ISO impact. Low-band performance was also improved based on the inclusion of 3 mm spacer, which reduced CMR impact on the low-band frequency range by increasing the effective length of the feed board/stalk 20. While the spacer may not significantly aid high-band performance, the increased capacitance may provide a sufficient improvement; however, it will be understood that the capacitance of the capacitor 130 cannot be significantly increased without affecting operation of the YB elements 114, ISO sensitivity, and/or front-to-back ratio degradation for the mid-band operating frequency range.

Figure 8:
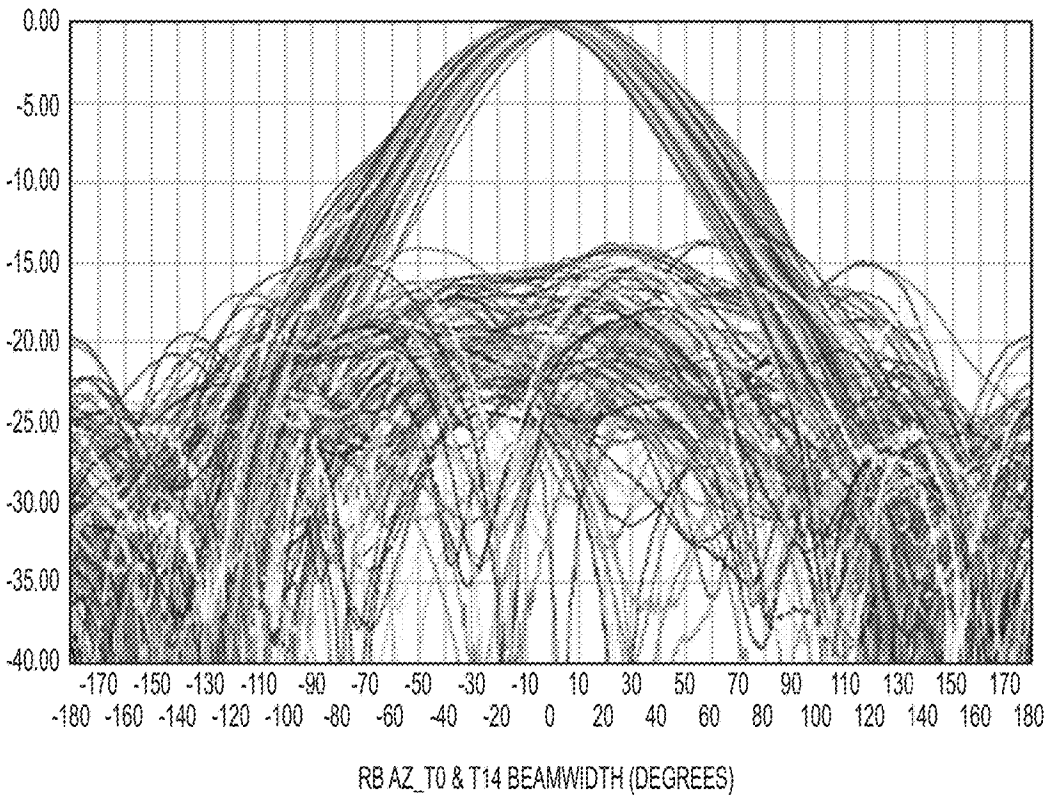
FIGS. 8 and 9 are graphs illustrating azimuth beamwidth patterns of a multi-band antenna array including mid-band (YB) radiating elements according to some embodiments of the present disclosure over the lower operating frequency range of the low-band (RB) elements and the higher operating frequency range for the high-band (VB) elements, respectively.
Figure 9:
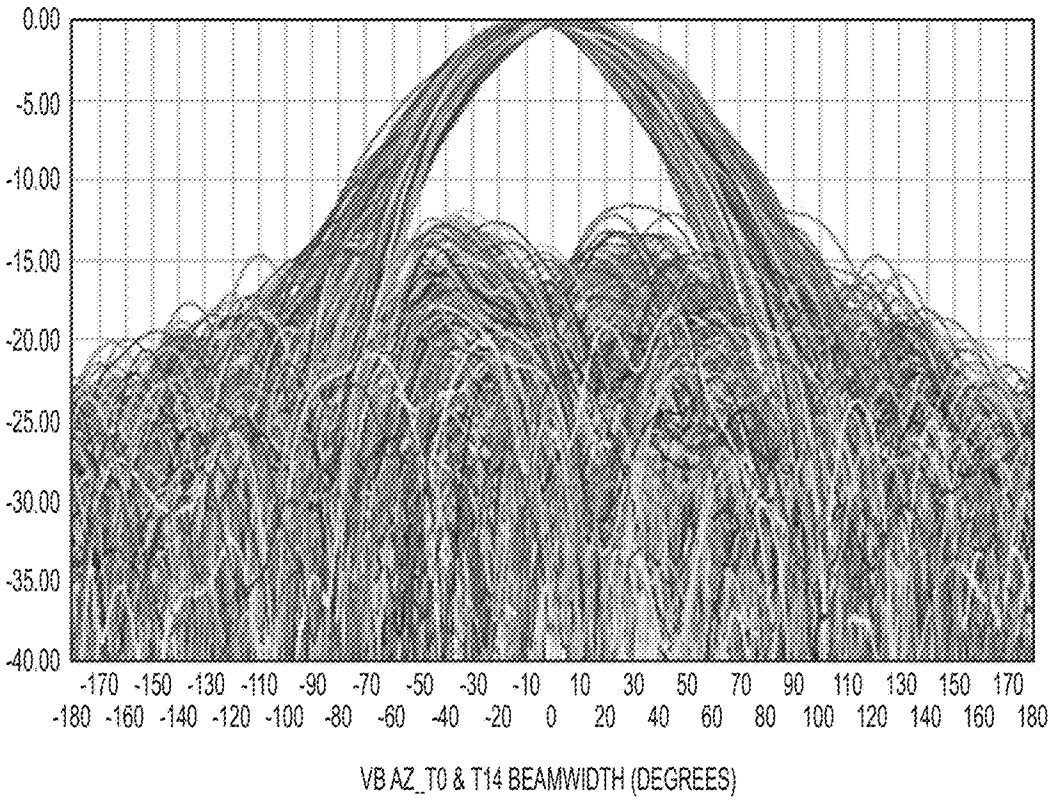

FIGS. 8 and 9 are graphs illustrating azimuth beamwidth performance (in degrees) for a multi-band antenna array according to embodiments of the present disclosure including YB radiating elements interspersed between RB radiating elements, which are aligned in a column and arranged between columns of V-band (VB) radiating elements, similar to the arrangement of FIG. 1C. In particular, FIG. 8 illustrates azimuth beamwidth patterns of the multi-band antenna array over the low-band RB operating frequency range (694-960 MHz), while FIG. 9 illustrates azimuth beamwidth patterns of the multi-band antenna array over the high-band VB operating frequency range (1695 MHz-2690 MHz). In FIGS. 8-9, the X axis is the azimuth angle, and Y-axis is the normalized power level over the test range. The YB radiating elements are arranged interspersed between RB radiating elements in a column that is arranged between columns of VB radiating elements on either side, with 80 mm lateral spacing between each of the three columns. The YB radiating elements also include a larger 6 mm*7 mm capacitor C1 coupling respective arm segments thereof to respective stalks thereof, and a 6 nH inductor L1 on each arm segment to couple the capacitor C1 to the metal segments defining portions of each dipole extending along the arm segments. FIGS. 8-9 illustrate that the RB and VB azimuth pattern is acceptable in embodiments of the present disclosure.

Figure 10A:
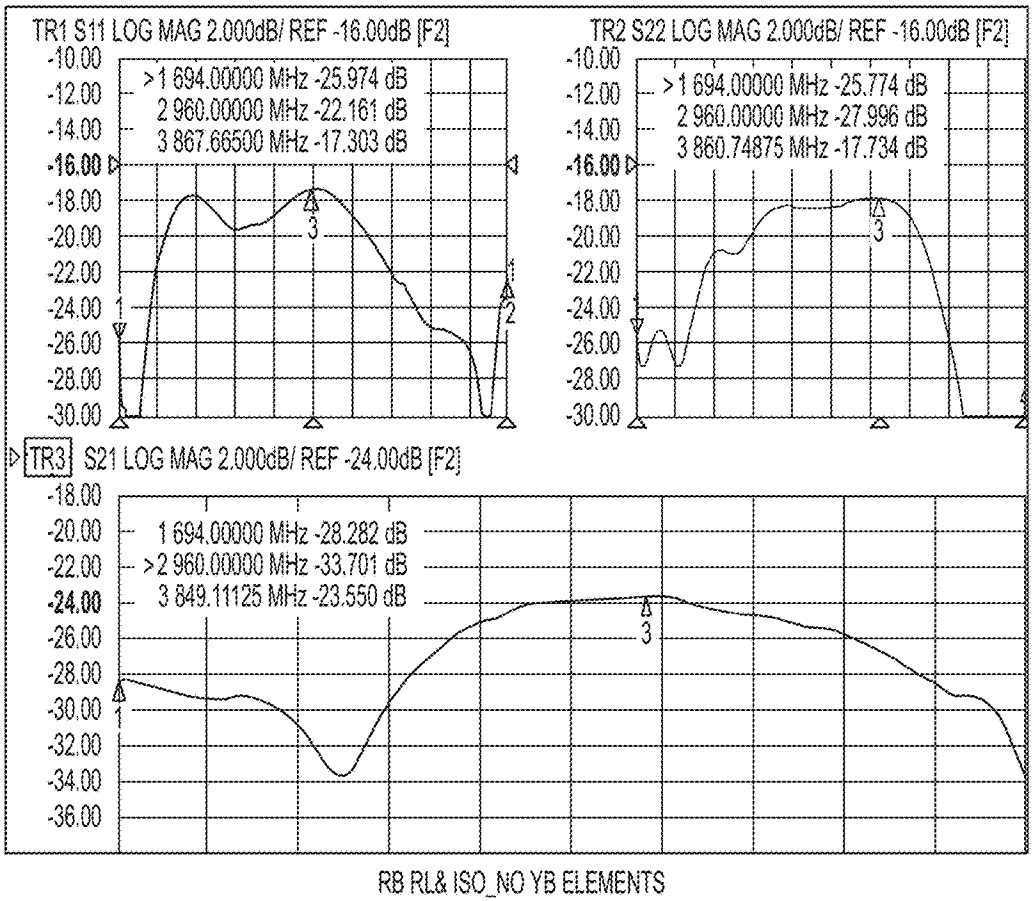
FIGS. 10A, 10B, and 10C are graphs illustrating DMR impact on return loss (RL) and isolation (ISO) performance over the lower operating frequency range of the RB elements of multi-band antenna arrays including no YB radiating elements, including YB radiating elements including two inductors, and including YB radiating elements including a capacitor and two inductors, respectively, according to some embodiments of the present disclosure.
Figure 10B:
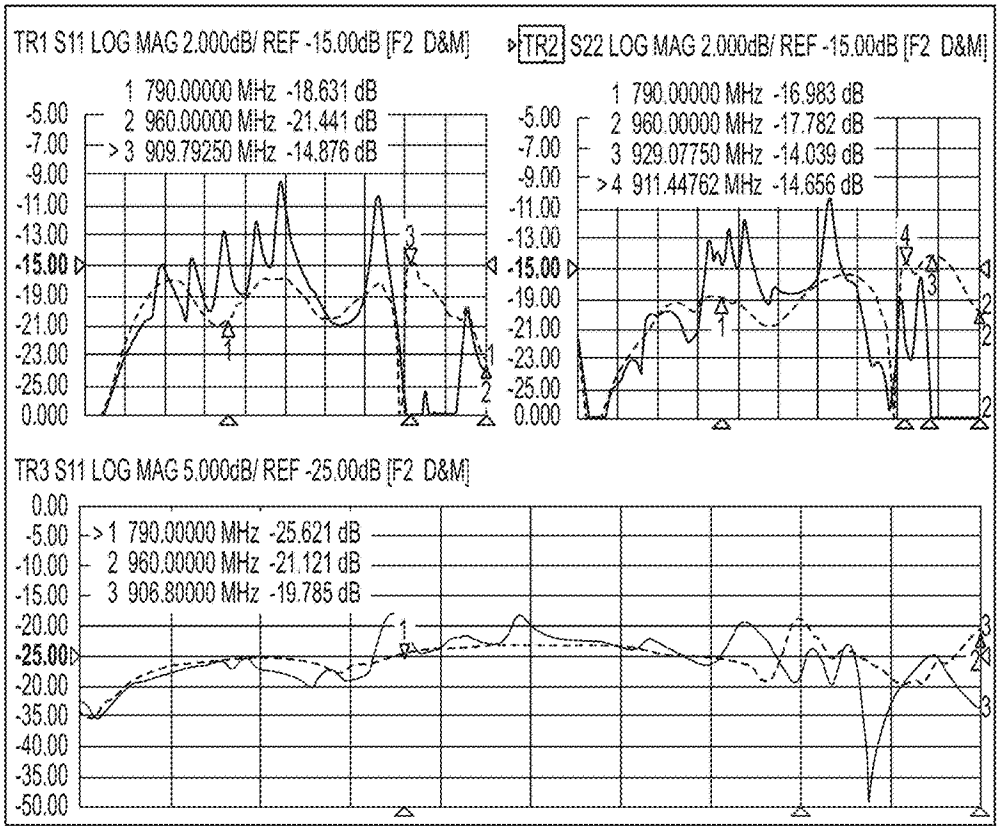
Figure 10C:
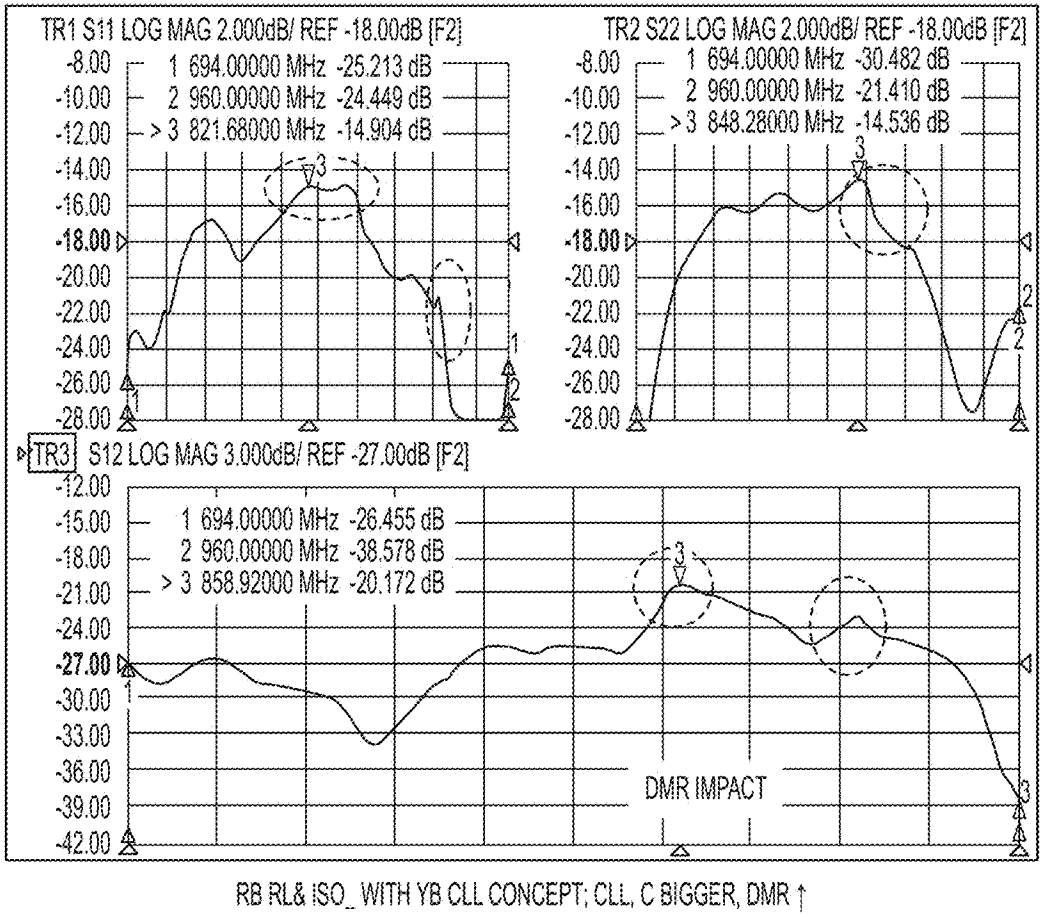

FIGS. 10A, 10B, and 10C are graphs based on bench data illustrating DMR impact on RL and ISO performance over the low-band RB operating frequency range of a multi-band antenna array. In particular, FIG. 10A illustrates baseline RL and ISO over the low-band RB operating frequency range (694-960 MHz) for a multi-band antenna array that does not include YB radiating elements therein. FIG. 10B illustrates DMR impact on RL and ISO over the low-band RB operating frequency range for a multi-band antenna array including YB radiating elements having two inductors L1, L2 arranged along respective arm segments thereof, similar to the configuration shown in FIG. 3A. FIG. 10C illustrates DMR impact on RL and ISO over the low-band RB operating frequency range for a multi-band antenna array including YB radiating elements having a capacitor C1 and two inductors L1, L2 arranged along respective arm segments thereof, similar to the configuration shown in FIGS. 5A and 5C-5E. In comparing the graphs of FIGS. 10A, 10B, and 10C, it is evident that the inclusion of the capacitor C1 to couple the arm segments of the YB radiating elements to the stalks thereof can significantly reduce DMR impact on the low-band performance that may be introduced by the inductors L1, L2.

Thus, according to some embodiments of the present disclosure, mid-band YB radiating elements may be interspersed in a column of low-band RB radiating elements, which is arranged between columns of high-band VB radiating elements of a multi-band radiating array, to cover a wider operating frequency range. In particular, embodiments of the present disclosure may include one or more of the following features, alone or in combination:

- The YB elements may be arranged to be co-linear with the RB elements in the column, with an inter-column spacing of about 80 mm between the column defined by the YB elements and the column defined by the VB elements.
- A capacitor C1 with a relatively small capacitance may be used to couple arm segments of the YB elements to stalks thereof may reduce DMR in the low-band, and even though DMR may increase with increased capacitance, the impact of DMR on low-band performance may not be significant. Also, in a longer antenna (for example, with three RB elements), there may be little impact of DMR on RL and ISO.
- In considering the effects of the capacitance provided by capacitor C1 on shifting CMR, there may be a tradeoff between the effects (for example, on ISO) of moving CMR to a higher frequency from the low-band, and the effects (for example, on azimuth beamwidth) of moving CMR into the upper end of the high-band (e.g., around 2500 MHz) and/or into the lower end of the high-band (e.g., around 1800 MHz).
- A spacer (for example, a 3 mm spacer) may be positioned or arranged beneath the YB elements. While the use of the coupling capacitor C1 between the arm segments and the stalk of the YB elements may result in moving CMR into the low-band, the spacer positioned beneath the YB elements may help reduce the impact of CMR on low-band performance.
- Inductors L1, L2 may be included on each arm segment, with inductance values (and capacitance values for the capacitor C1) selected based on a trade-off between CMR effects on the lower end of the high-band and CMR effects on the upper end of the high-band.
- A ground area of the YB element feed board (and/or an area of the reflector/ground plane surrounding the YB element feed board) may be cut or otherwise reduced, in addition or as an alternative to adding the spacer beneath the feed board of the YB element, to aid decoupling DMR in the low-band.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

Unless otherwise defined, all technical and scientific terms used herein have the same meaning as commonly understood by one of ordinary skill in the art to which this invention belongs. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Aspects and elements of all of the embodiments disclosed above can be combined in any way and/or combination with aspects or elements of other embodiments to provide a plurality of additional embodiments.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A multi-band radiating array, comprising:

a planar reflector;

a plurality of first radiating elements defining a first column on the planar reflector, the first radiating elements having a first operating frequency range;

a plurality of second radiating elements defining a second column on the planar reflector alongside the first column, the second radiating elements having a second operating frequency range that is lower than the first operating frequency range;

a plurality of third radiating elements on the planar reflector interspersed between the second radiating elements in the second column, the third radiating elements having a third, narrowband operating frequency range that is higher than the second operating frequency range but lower than the first operating frequency range.

2. The array of claim 1, wherein the second and third radiating elements respectively comprise:

a plurality of elongated arm segments defining at least one dipole antenna; and an elongated stalk that suspends the elongated arm segments above the planar reflector such that the elongated arm segments radially extend from an end of the elongated stalk and parallel to the planar reflector, wherein the third radiating elements respectively comprise:

respective capacitors coupled between the elongated arm segments and the elongated stalk thereof, wherein a common mode resonance of the third radiating elements is present in a lower frequency range than the second operating frequency range.

3. The array of claim 2, wherein the third radiating elements further respectively comprise:

respective inductors extending along a length of the elongated arm segments, wherein the respective inductors are serially coupled to the respective capacitors opposite the elongated stalk.

4. The array of claim 3, wherein the respective inductors comprise respective first inductors, and wherein the third radiating elements further respectively comprise:

respective second inductors extending along the length of the elongated arm segments and serially coupled to the respective first inductors opposite the respective capacitors such that the respective capacitors, the respective first inductors, and the respective second inductors are connected in series.

5. The array of claim 4, wherein the elongated arm segments comprise printed circuit boards including respective metal segments thereon, and the at least one dipole antenna comprises first and second dipole antennas defined by the respective metal segments on opposing ones of the elongated arm segments in a cross dipole arrangement.

6. The array of claim 5, wherein:

the respective first inductors comprise respective first metal traces on the printed circuit boards coupling the respective capacitors to portions of the respective metal segments proximate the elongated stalk; and the respective second inductors comprise respective second metal traces on the printed circuit boards extending between portions of the respective metal segments distal from the elongated stalk.

7. The radiating element of claim 6, wherein, for the third radiating elements, the elongated stalk comprises a dielectric feed board substrate and metal layers on opposing surfaces thereof that define the respective capacitors.

8. The array of claim 2, wherein the planar reflector comprises respective openings therein around respective elongated stalks of the third radiating elements, wherein the respective openings are configured to reduce coupling between the respective elongated stalks of the third radiating elements and the planar reflector.

9. The array of claim 2, wherein at least two of the third radiating elements are interspersed between two of the second radiating elements in a co-linear arrangement such that respective elongated stalks thereof are aligned along the second column.

10. The array of claim 1, further comprising a plurality of the first radiating elements defining a third column alongside the second column opposite the first column such that the third radiating elements are positioned between the first and third columns.

11. The array of claim 1, wherein the third radiating elements are laterally spaced by about 80 millimeters (mm) from the first radiating elements of the first column.

12. The array of claim 1, wherein the first operating frequency range is about 1.7 GHz to about 2.7 GHz, wherein the second operating frequency range is about 694 MHz-960 MHz, and wherein the third, narrowband operating frequency range is about 1.4 GHz to about 1.5 GHz.

13. The array of claim 1, wherein the narrowband operating frequency range is about 1.4 GHz to about 1.5 GHz, and wherein the lower frequency range is less than about 690 MHz.

14. A radiating element, comprising:

a plurality of elongated arm segments defining at least one dipole antenna having a narrowband operating frequency range;

an elongated stalk configured to suspend the elongated arm segments above a planar reflector such that the elongated arm segments radially extend from an end of the elongated stalk and parallel to the planar reflector; and respective capacitors coupled between the elongated arm segments and the elongated stalk, wherein a common mode resonance of the radiating element is present in a lower frequency range than the narrowband operating frequency range.

15. The radiating element of claim 14, further comprising:

respective inductors extending along a length of the elongated arm segments, wherein the respective inductors are serially coupled to the respective capacitors opposite the elongated stalk.

16. The radiating element of claim 15, wherein the respective inductors comprise respective first inductors, and further comprising:

respective second inductors extending along the length of the elongated arm segments and serially coupled to the respective first inductors opposite the respective capacitors such that the respective capacitors, the respective first inductors, and the respective second inductors are connected in series.

17. The radiating element of claim 16, wherein the elongated arm segments comprise printed circuit boards including respective metal segments thereon, and the at least one dipole antenna comprises first and second dipole antennas defined by the respective metal segments on opposing ones of the elongated arm segments in a cross dipole arrangement.

18. The radiating element of claim 17, wherein:

the respective first inductors comprise respective first metal traces on the printed circuit boards coupling the respective capacitors to portions of the respective metal segments proximate the elongated stalk; and the respective second inductors comprise respective second metal traces on the printed circuit boards extending between portions of the respective metal segments distal from the elongated stalk.

19. The radiating element of claim 18, wherein the elongated stalk comprises a dielectric feed board substrate and metal layers on opposing surfaces thereof that define the respective capacitors.

20. The radiating element of claim 19, wherein the printed circuit boards comprise first and second printed circuit boards arranged in a crossed configuration to define the dielectric feed board substrate and the elongated arm segments, wherein the first and second dipole antennas are defined by the metal segments of the first and second printed circuit boards, respectively, and wherein the dielectric feed board comprises feed lines that are configured to couple the first and second dipole antennas to an antenna feed.

21. The radiating element of claim 20, further comprising:

a spacer positioned at an end of the dielectric feed board substrate opposite from the elongated arm segments.

* * * * *